United States Patent [19]

Tanaka et al.

[11] Patent Number: 4,909,116

[45] Date of Patent: Mar. 20, 1990

[54] ELECTRONIC MUSICAL INSTRUMENT GENERATING BACKGROUND MUSICAL TONE

[75] Inventors: So Tanaka; Tom Taniwaki; Ninoru Harada, all of Hamamatsu, Japan

[73] Assignee: Yamaha Corporation, Hamamatsu, Japan

[21] Appl. No.: 211,331

[22] Filed: Jun. 24, 1988

[30] Foreign Application Priority Data

Jun. 26, 1987 [JP] Japan ..... 62-160466
Jun. 26, 1987 [JP] Japan ..... 62-160467

[51] Int. Cl.[4] ..... G10H 1/02; G10H 1/06; G10H 1/46

[52] U.S. Cl. ..... 84/692; 84/698; 84/711

[58] Field of Search ..... 84/1.01, 1.03, 1.09–1.13, 84/1.17, 1.19–1.28, DIG. 2, DIG. 12, DIG. 22

[56] References Cited

U.S. PATENT DOCUMENTS

| | | | |
|---|---|---|---|
| 4,429,606 | 2/1984 | Aoki . | |
| 4,450,742 | 5/1984 | Sugiura . | |
| 4,510,836 | 4/1985 | Markowitz | 84/1.26 |
| 4,773,294 | 9/1988 | Iizuka et al. | 84/1.01 |
| 4,779,505 | 10/1988 | Suzuki | 84/1.22 |

*Primary Examiner*—Stanley J. Witkowski
*Attorney, Agent, or Firm*—Spensley, Horn, Jubas & Lubitz

[57] ABSTRACT

An electronic musical instrument includes a keyboard, a first tone generator, a second tone generator, a hold switch, and a control unit. The keyboard designates a pitch of a musical tone to be generated. The first tone generator generates a first musical tone signal corresponding to the pitch designated by the keyboard. The second tone generator generates a second musical tone signal corresponding to the pitch designated by the keyboard. The hold switch generates a pitch hold command. When the pitch hold command is generated, the control unit inhibits a pitch change in the second musical tone signal generated by the second tone generator to hold a predetermined pitch.

11 Claims, 16 Drawing Sheets

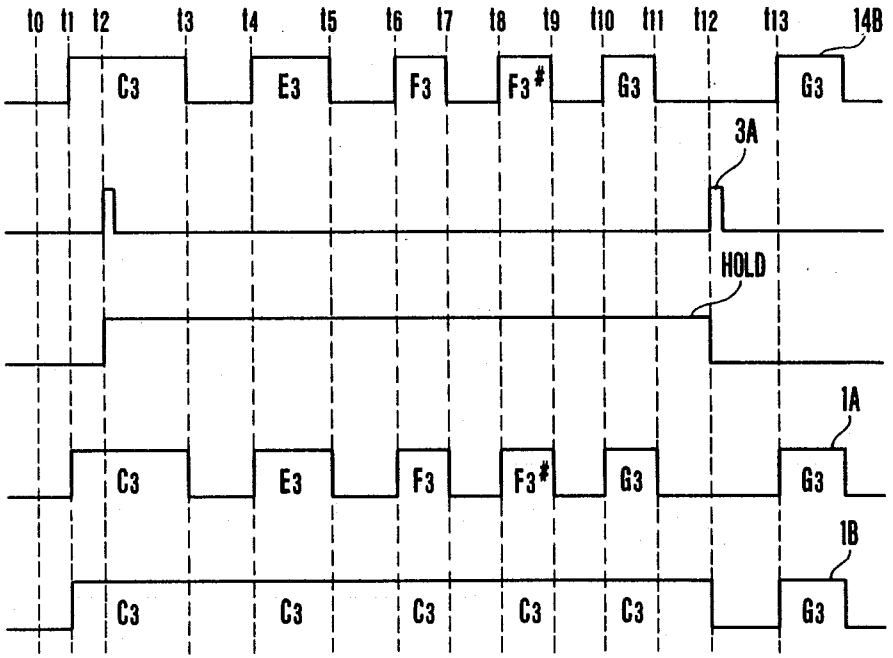
FIG.12A
FIG.12B
FIG.12C
FIG.12D
FIG.12E
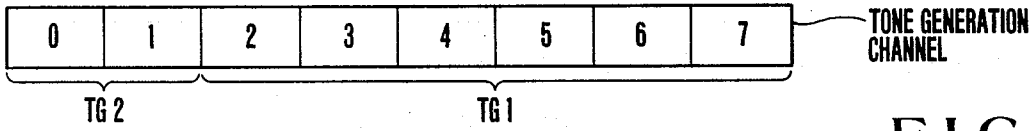
FIG.13

| PITCH | C1 | C1# | --- | C2 | --- | C3 | --- | C4 | --- | C5 | --- | C6 |
|---|---|---|---|---|---|---|---|---|---|---|---|---|
| KEY CODE | 24 | 25 | --- | 36 | --- | 48 | --- | 60 | --- | 72 | --- | 84 |

ELECTRONIC MUSICAL INSTRUMENT GENERATING BACKGROUND MUSICAL TONE

BACKGROUND OF THE INVENTION

The present invention relates to an electronic musical instrument and, more particularly, to an electronic musical instrument which can simultaneously generate musical tones having a plurality of tone colors.

In some conventional electronic musical instruments, a keyboard is used as a pitch designating means, and pitches are sequentially designated by operating keys of the keyboard, thereby simultaneously generating musical tones having a plurality of pitches predetermined with respect to the pitches of the designated keys.

First, for example, tones having a tone color of an orchestra and those having a tone color of a flute are prepared. When a performer depresses a key, two musical tones having the same pitch as that of the depressed key or pitches offset from each other by an octave are generated, thereby generating a so-called ensemble effect in a performance tone.

Second, when a performer depresses keys, pitches of musical tones of the first tone group are changed in accordance with changes in pitches of sequentially-depressed keys. At the same time, pitches of musical tones of the second tone group are changed to have a predetermined pitch difference with respect to the musical tones of the first tone group, thereby generating a so-called duet effect in a performance tone.

However, in the conventional electronic musical instruments of this type, a pitch difference of musical tones simultaneously generated and having different tone colors is permanently determined with respect to the pitch of a depressed key. Therefore, a performance tone tends to be monotonous, resulting in insufficient musical expressions as an electronic musical instrument. This problem is serious in a music synthesizer, especially in a music synthesizer of wind instrument type because only one pitch can be designated in this synthesizer.

In addition, in the conventional electronic musical instruments, a pitch difference of a harmonic tone to be added to a melody tone is predetermined with respect to the melody tone. Therefore, an expression of a performance tone becomes insufficient.

SUMMARY OF THE INVENTION

It is, therefore, a principal object of the present invention to provide an electronic musical instrument generating a main musical tone and a background musical tone, in which the background musical tone generated substantially simultaneously with the main musical tone can be arbitrarily set, thereby obtaining an expressive performance tone.

It is another object of the present invention to provide an electronic musical instrument which can generate a background musical tone generated substantially simultaneously with a main musical tone and having a specified pitch difference with respect to the main musical tone even when the main musical tone is varied, thereby generating a more expressive musical tone and providing a so-called duet effect.

In order to achieve the above objects of the present invention, there is provided an electronic musical instrument comprising pitch designating means for designating a pitch of a musical tone to be generated, first musical tone generating means for generating a first musical tone signal corresponding to the pitch designated by the pitch designating means, second musical tone generating means for generating a second musical tone signal corresponding to the pitch designated by the pitch designating means, pitch hold designating means for generating a pitch hold command, and control means for, when the pitch hold command is generated, inhibiting a pitch change in the second musical tone signal generated by the second musical tone generating means to hold a predetermined pitch.

BRIEF DESCRIPTION OF THE DRAWINGS

FIGS. 12A to 12E are timing charts for explaining an operation;

FIG. 13 is a schematic view for explaining channel assignment according to a modification of the present invention;

DETAILED DESCRIPTION OF THE PREFERRED EMBODIMENTS OVERALL ARRANGEMENT

An embodiment of the present invention applied to a keyboard type electronic musical instrument which can generate a plurality of, e.g., two musical tones having different tone colors will be described in detail below with reference to the accompanying drawings.

Figure 1:
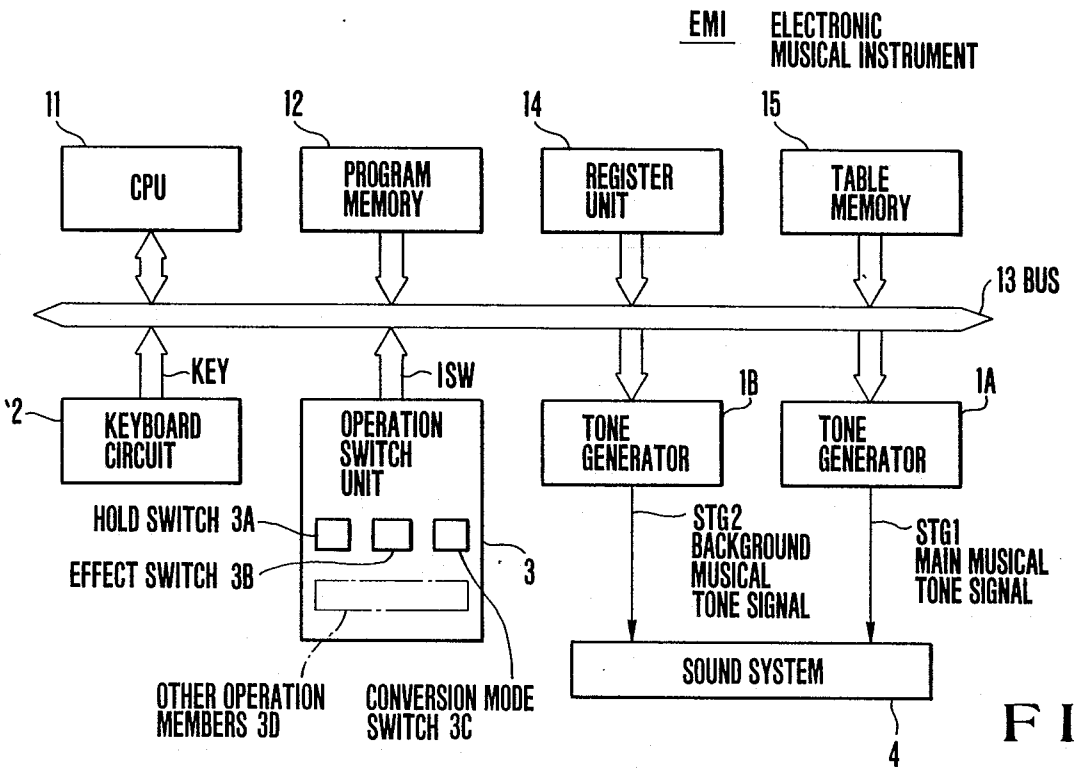
FIG. 1 is a block diagram showing an overall arrangement of an electronic musical instrument according to an embodiment of the present invention.

In FIG. 1, reference symbol EMI denotes an entire electronic musical instrument which includes firs and second tone generators 1A and 1B as musical tone generating means for generating different tone colors, i.e., first and second tone colors, respectively. The tone generators 1A and 1B generate a main musical tone signal STG1 and a background musical tone signal STG2, respectively, and supply the signals to a sound system 4 on the basis of key information KEY supplied from a keyboard circuit 2 as a common pitch designating means and operation input information ISW supplied from an operation switch unit 3.

The first and second tone generators 1A and 1B will be referred to as a TG1 1A and a TG2 1B, respectively, hereinafter.

When a CPU 11 controls the first and second tone generators 1A and 1B (TG1 and TG2) in accordance with key on or key off processing, the TG1 1A and the TG2 1B continuously generate the main and background musical tones having a pitch corresponding to designated key code data or continuously stop generation of the tones.

In this embodiment, the TG1 1A generates the main musical tone signal STG1 corresponding to a main musical tone which constitutes a main melody in a performance tone generated by the sound system 4. Meanwhile, the TG2 1B generates the background musical tone signal STG2 corresponding to a background musical tone which constitutes a background melody.

When the TG2 1B generates the background musical tone on the basis of the key information KEY and the operation input information ISW supplied from the keyboard circuit 2 and the operation switch unit 3, respectively, the TG2 1B can hold generation conditions of this musical tone (this function is called a "hold" function). Therefore, the background musical tone determined under tone generation conditions selected by a performer in accordance with necessity can be generated simultaneously with a main musical tone generated by the TG1 1A.

In this embodiment, the TG1 1A and TG2 1B simultaneously generate eight musical tones by assigning data of the eight musical tones in time slots of eight channels which are time-divisionally formed.

In the electronic musical instrument EMI, when a key of the keyboard 2 is depressed or released by a performer to be operated on or off (this is called a key on event or key off event), the key information KEY input from the keyboard circuit 2 is supplied to a register 14 constituted by a RAM by a central processing unit (CPU) 11 constituted by a microcomputer through a bus 13 in accordance with program data stored in a program memory 12 constituted by a ROM. At the same time, the main and background musical tone signals STG1 and STG2 generated by the TG1 1A and TG2 1B are controlled using conversion data stored in a table memory 15 constituted by a ROM, thereby controlling an effect added to a performance tone.

The operation switch unit 3 includes a hold switch 3A, an effect switch 3B, a conversion mode switch 3C, and other operation members 3D. When any of the switches is operated on (this is called an on event) by a performer, the CPU 11 fetches information of this switch.

The hold switch 3A is used to hold tone generation conditions of the background musical tone generated by the TG2 1B. A performer can alternately designate/input "hold" or "hold release" by a toggle operation of the hold switch 3A.

With the effect switch 3B, a performer can arbitrarily set a volume of the musical tone generated from the sound system 4 on the basis of the musical tone signals STG1 and STG2 of the TG1 1A and TG2 1B. The effect switch 3B is constituted by, e.g., an effect volume comprising a variable resistor. When a set value EFT is changed by variably operating a position of the effect switch 3B, a volume can be set in accordance with one of a plurality of, e.g., five conversion modes (MODE = 0) to (MODE = 4) as shown in FIGS. 2A to 2E.

With the conversion mode switch 3C, a performer can selectively designate the conversion modes of the effect switch 3B. That is, numerical data representing five modes (MODE = 0) to (MODE = 4) can be designated/input by the conversion mode switch 3C.

With the other operation members 3D, a performer can input the other conditions required for generating a musical tone such as a tone color designation switch.

In this embodiment, the conversion data described with reference to FIGS. 2A to 2E are stored in the table memory 15. When the CPU 11 reads one of conversion mode numbers (MODE = 0) to (MODE = 4) input by the conversion mode switch 3C, a conversion table corresponding to the number is selected in the table memory 15. Thereafter, the set value EFT of the effect switch 3B is converted by the selected conversion table to obtain conversion data EFT2. The conversion data EFT2 is supplied to the TG1 1A and TG2 1B as musical tone control information.

Figure 2A:
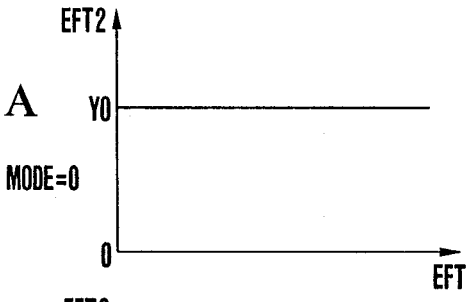
FIGS. 2A to 2E are characteristic curves showing conversion volume control data of a table memory 15 of FIG. 1.

In this embodiment, as shown in FIG. 2A, when the set value EFT of the effect switch 3B is changed, a conversion table of the 0th conversion mode (MODE = 0) outputs conversion data Y0 as conversion control data EFT2 for maintaining a volume of a background musical tone generated when the 0th conversion mode is selected regardless of the change.

Figure 2B:
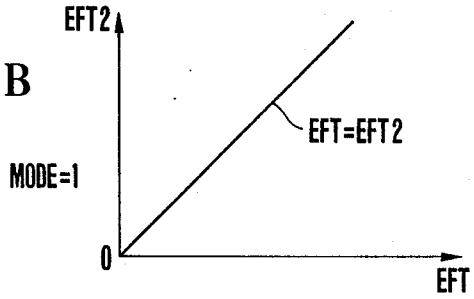

As shown in FIG. 2B, when the set value EFT of the effect switch 3B is increased, a conversion table of the 1st conversion mode (MODE = 1) supplies this increase as the conversion data EFT2. Therefore, when a performer sets the set value EFT of the effect switch 3B to be increased or decreased, a volume of the background musical tone can be proportionally increased or decreased.

Figure 2C:
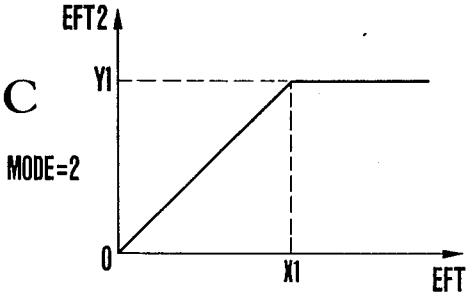

As shown in FIG. 2C, a conversion table of the 2nd conversion mode (MODE = 2) linearly changes the conversion data EFT2 from 0 to Y1 when the set value EFT of the effect switch 3B falls within the range of 0 to X1, and maintains the conversion data EFT2 at the upper limit Y1 when the set value EFT exceeds X1. Therefore, when a performer increases a volume using the effect switch 3B, a volume of the background musical tone is suppressed below a predetermined volume, i.e., the background musical tone does not become too loud.

Figure 2D:
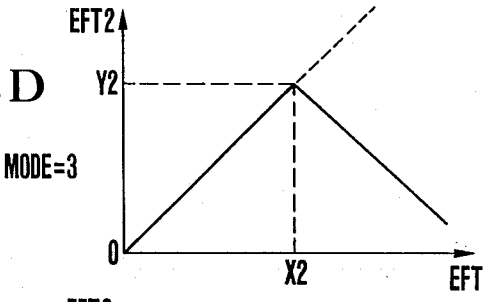

As shown in FIG. 2D, when the set value EFT of the effect switch 3B exceeds a predetermined value X2, a conversion table of the 3rd conversion mode (MODE = 3) changes to linearly decrease the value of the conversion data EFT2 from Y2. Therefore, as indicated by a broken line, a main musical tone generated by the TG1 1A is linearly increased as the set value EFT is increased larger than X2 in accordance with an operation of the effect switch 3B, while a volume of a background musical tone generated by the TG2 1B is linearly reduced. As a result, an average value of volumes of the main and background musical tones is maintained to be a value substantially corresponding to conversion data EFT2 = Y2. Therefore, the main musical tone can be enhanced while the background musical tone is suppressed.

Figure 2E:
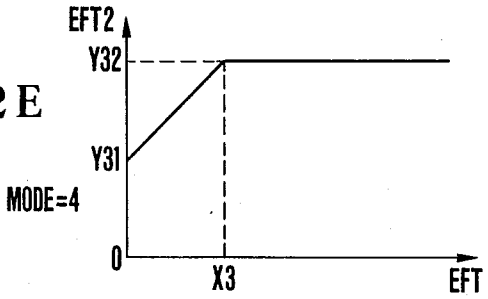

As shown in FIG. 2E, a conversion table of the 4th conversion mode (MODE = 4) outputs an offset value Y31 as the conversion data EFT2 when the set value EFT of the effect switch 3B is 0. In addition, this conversion table changes such that the conversion data EFT2 is linearly increased from Y31 to Y32 when the set value EFT1 is increased within the range of 0 to X3 and the conversion data EFT2 is maintained at the upper limit Y32 when the set value EFT exceeds X3. Therefore, a volume of the background musical tone generated by the TG2 1B can be enhanced with respect to the main musical tone generated by the TG1 1A by an amount of the offset Y31 of the conversion data EFT2.

Figure 3:
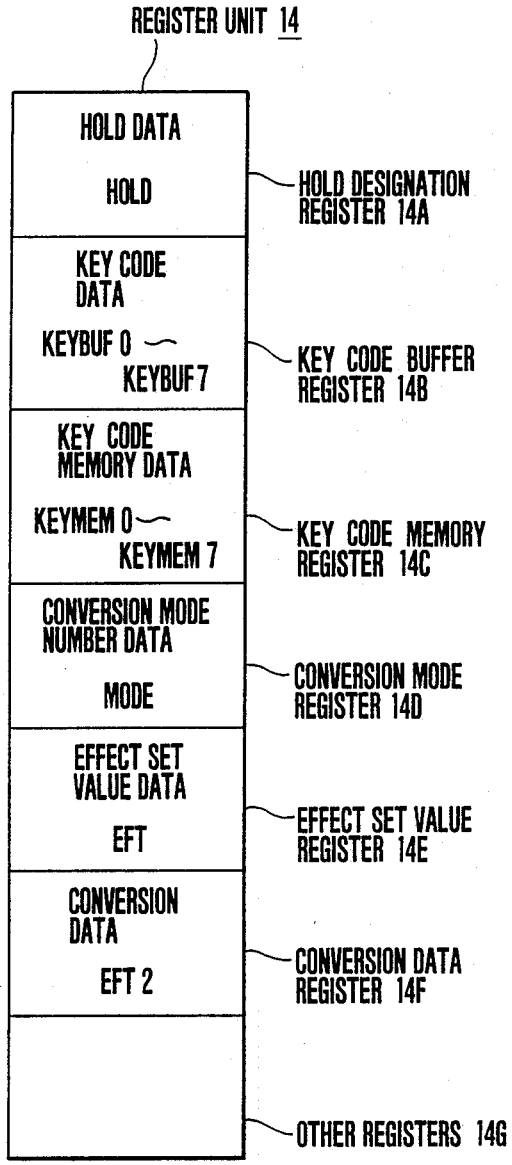
FIG. 3 is a schematic view showing in detail an arrangement of a register unit 14 of FIG. 1.

As shown in FIG. 3, the register unit 14 includes various registers.

A hold designation register 14A stores hold data HOLD consisting of a flag representing whether tone generation information of a background musical tone in the TG2 1B is to be held or released. The hold designation register 14A fetches and stores switch data of the hold switch 3A. The tone generation information includes pitch information and ON/OFF information of the TG2 1B and goes to logic level "1" when "hold" is designated.

A key code buffer register 14B fetches and stores key code data of a depressed key of the keyboard circuit 2. In this embodiment, since a plurality of, e.g., eight tones can be simultaneously generated, the key code buffer register 14B stores key code data KEYBUF0 to KEYBUF7.

A key code memory register 14C stores a tone generation key code of the TG2 1B which is designated to be held. When the key code data KEYBUF0 to KEYBUF7 of the key code buffer register 14B are transferred, the key code memory register 14C fetches and stores these data as key code memory data KEYMEM0 to KEYMEM7.

A conversion mode register 14D stores conversion mode number data MODE (MODE = 1 to MODE = 4) representing the conversion tables (FIGS. 2A to 2E) used with respect to the volume set value EFT. The conversion mode register 14D fetches and stores a set value of the conversion mode switch 3C.

An effect set value register 14E fetches and stores set value data EFT representing a set value of the effect switch 3B.

A conversion data register 14F stores conversion data EFT2 obtained by converting the effect set value EFT using the conversion tables (FIGS. 2A to 2E).

Other registers 14G store data used to generate the musical tone signals STG1 and STG2 in the TG1 1A and TG2 1B.

Musical Tone Generation Processing

Figure 4:
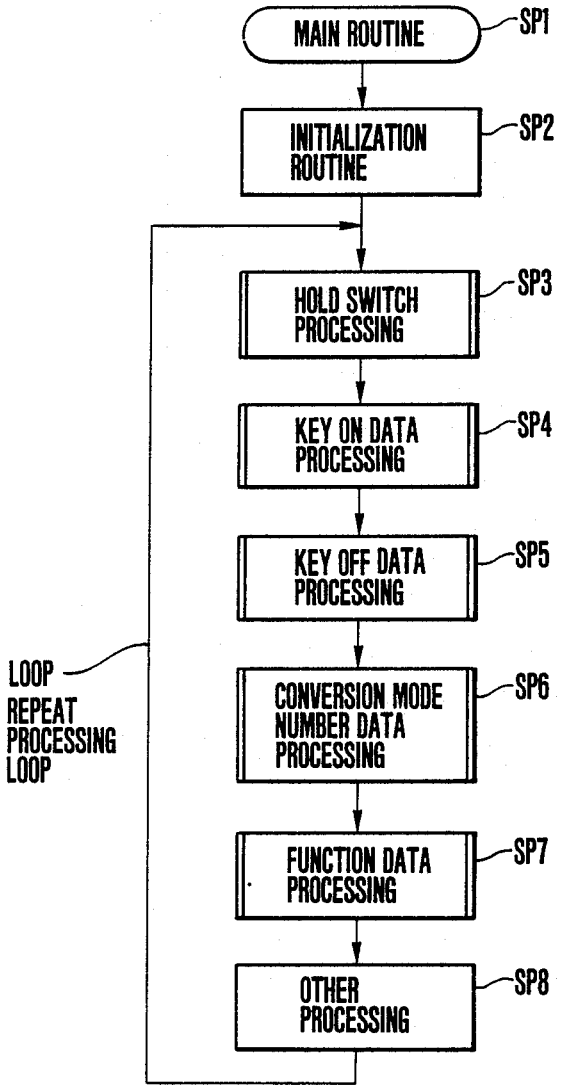
FIG. 4 is a flow chart for explaining a musical tone generation processing routine of a CPU 11 of FIG. 1.

With the above arrangement, the CPU 11 executes a main routine of a musical tone generation processing program shown in FIG. 4. As a result, a performance tone in which a melody of a background musical tone is added to that of a main musical tone is generated in accordance with an operation of a performer.

That is, when a power switch is turned on, the CPU 11 starts a main routine in step SP1 and executes an initialization routine in step SP2, thereby resetting storage data of the registers of the register unit 14 such as the hold designation register 14A and the key code buffer register 14B to be initial values.

When initialization is finished, the CPU 11 executes a processing routine of data of the hold switch 3A of the operation switch unit 3 in step SP3. Thereafter, in steps SP4 and SP5, the CPU 11 executes a key on data processing routine for a depressed key and a key off data processing routine for a released key on the keyboard circuit 2, respectively. Subsequently, the CPU 11 executes a processing routine of the conversion mode number data MODE in step SP6, and executes a processing routine of function data having volume control contents for the TG1 1A and TG2 1B on the basis of a result in step SP6. In step SP8, the CPU 11 executes other processing such as tone color switching, and then the flow returns to step SP3.

Thereafter, the CPU 11 similarly executes a repeat processing routine loop LOOP of steps SP3–SP4–SP5–SP6–SP7–SP8–SP3 every predetermined period. Therefore, when a performer operates the keyboard circuit 2 and the operation switch unit 3 in accordance with necessity, data input by the operation can be momentarily processed.

Figure 5:
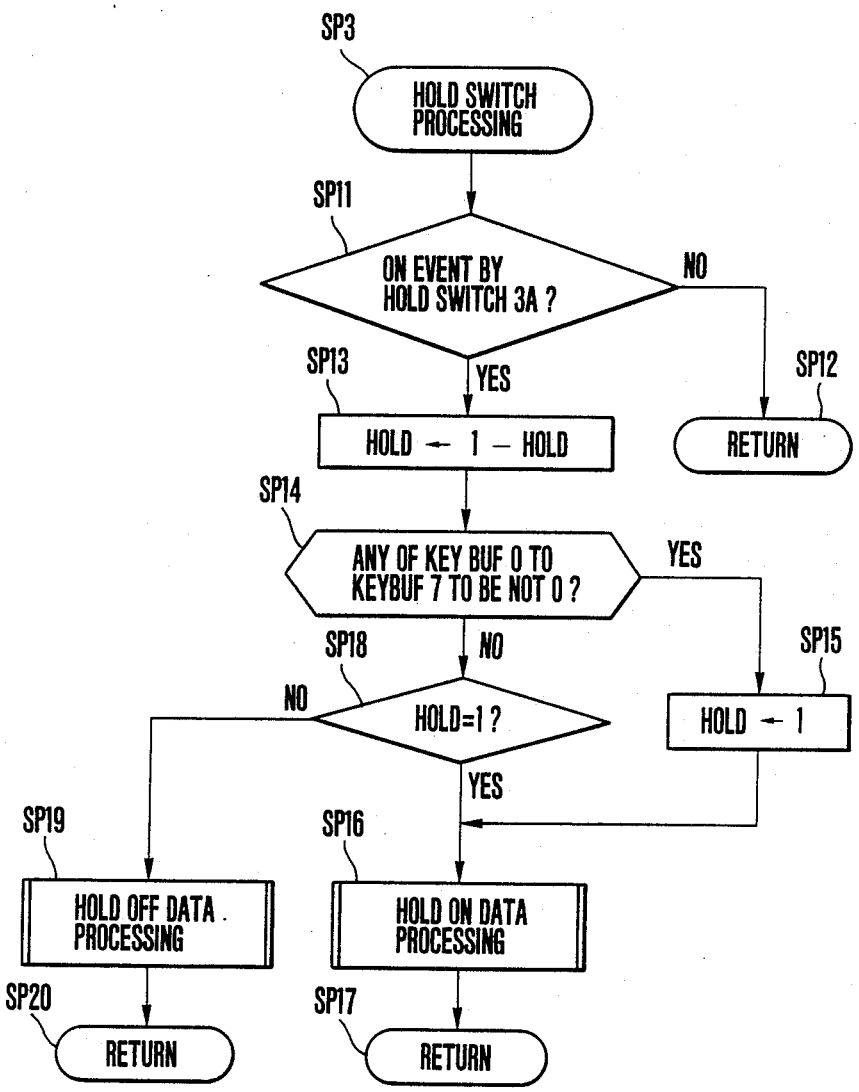
FIG. 5 is a flow chart for explaining a hold switch processing routine of FIG. 4.

The hold switch processing routine in step SP3 of the main routine in FIG. 4 is constituted by a subroutine shown in FIG. 5. In step SP11, the CPU 11 checks whether an on event is present on the hold switch 3A. If N (NO) in step SP11, the flow returns from step SP12 to the main routine. That is, in this case, a performer does not designate a hold function, and therefore the CPU 11 does not execute other hold switch processing and the flow directly returns to the main routine.

If Y (YES) in step SP11, it is determined that the performer operates the hold switch 3A. Therefore, the flow advances to step SP13, and the CPU 11 executes calculation of 1—HOLD using the hold data HOLD stored in the hold designation register 14A. The calculation result is written in the hold designation register 14A as new hold data HOLD, thereby updating the content ("0" or "1") to inverted data (i.e., "1" − "0" = "1" or "1" − "1" = "0").

Whenever the hold switch 3A having a toggle switch arrangement is operated, the CPU 11 rewrites the hold data HOLD of the hold designation register 14A from "0" to "1" or vice versa.

Subsequently, in step SP14, the CPU 11 checks whether any of the key code data KEYBUF0 to KEYBUF7 fetched in the key code buffer register 14B and having the content of not "0" is present. If Y in step SP14, it is determined that any of keys on the keyboard 2 is operated and a key code is assigned to one of channels (in this embodiment, eight channels) corresponding to musical tones which can be simultaneously generated. Therefore, the flow advances to step SP15, and the CPU 11 writes the hold data HOLD of "1" in the hold designation register 14A. Then, in step SP16, the CPU 11 executes hold on data processing, and the flow returns from step SP17 to the main routine.

That is, when any of the keys on the keyboard circuit 2 is depressed, the CPU 11 executes the hold on data processing in step SP16.

However, if N in step SP14, it is determined that no key is depressed on the keyboard circuit 2. Therefore, the flow advances to step SP18, and the CPU 11 checks whether the hold data HOLD of the hold designation register is "1". If Y in step SP18, the CPU 11 executes the hold on data processing described above in steps SP16 and SP17. If N in step SP18, the flow advances to step SP19, and the CPU 11 executes hold off data processing. Thereafter, the flow returns from step SP20 to the main routine.

That is, when no key is operated on the keyboard circuit 2 and the hold data HOLD of the hold designation register 14A is "0" (i.e., the performer does not designate the hold operation), the CPU 11 executes the hold off data processing.

Figure 6:
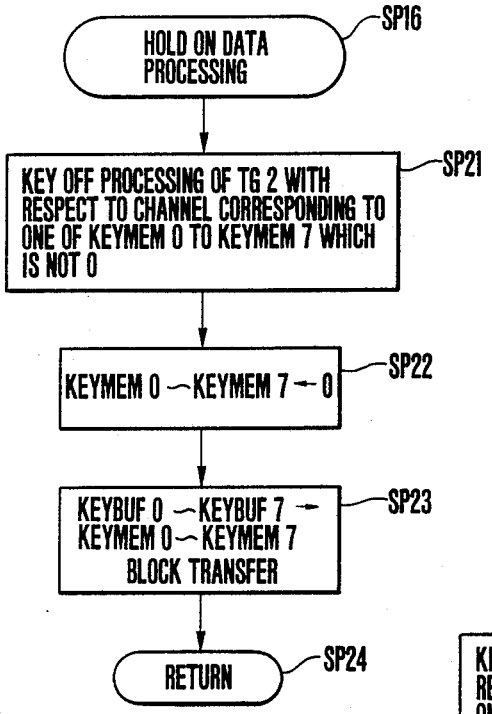
FIG. 6 is a flow chart for explaining a hold on data processing routine of FIG. 5.

The hold on data processing in step SP16 of FIG. 5 is executed in accordance with a subroutine shown in FIG. 6.

That is, when the hold on data processing is started in step SP16, the CPU 11 executes the key off processing for the background musical tone signal STG2 in the TG2 1B with respect to a channel corresponding to one of the key code memory data KEYMEM0 to KEYMEM7 which is not "0" of the key code memory register 14C in step SP21. Thereafter, in step SP22, the CPU 11 clears the key code memory data KEYMEM0 to KEYMEM7 of the key code memory register 14C to be "0". After the data held in the key code memory register 14C are cleared, the flow advances to step SP23, and the CPU 11 block-transfers the key code data KEYBUF0 to KEYBUF7 of the key code buffer register 14B to the key code memory register 14C. The KEYBUF0 to KEYBUF7 are stored in the key code memory register 14C as the key code memory data KEYMEM0 to KEYMEM7.

As a result, new data representing a current key depression state on the keyboard circuit 2 of eight channels are stored in the key code memory register 14C. Thereafter, the flow returns from step SP24 to the main routine.

According to the subroutine in FIG. 6, the data stored in the key code memory register 14C are temporarily cleared, and new data fetched in the key code buffer register 14B are written in the key code memory register 14C.

Figure 7:
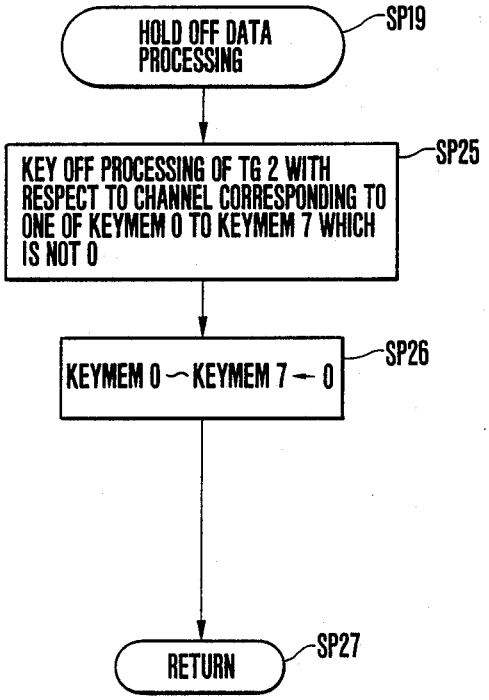
FIG. 7 is a flow chart for explaining a hold off data processing routine of FIG. 5.

The hold off data processing in step SP19 of FIG. 5 is executed in accordance with a subroutine shown in FIG. 7.

That is, the CPU 11 starts this subroutine from step SP19. In step SP25, the CPU 11 executes key off processing for a background musical tone in the TG2 1B with respect to a channel corresponding to one of the key code memory data KEYMEM0 to KEYMEM7 which is not "0" in the key code register 14C. Then, in step SP26, the CPU 11 clears the key code memory data KEYMEM0 to KEYMEM7 in the key code memory register 14C to be "0".

After the CPU 11 clears the key code memory data KEYMEM0 to KEYMEM7 stored in the key code memory register 14C, the flow returns from step SP27 to the main routine.

In the hold switch processing routine of FIG. 5, in order to write hold data HOLD = 1 (information for commanding "hold" of tone generation information concerning the background musical tone) in the hold designation register 14A, any of keys on the keyboard circuit 2 is operated and then the hold switch 3A is operated. Alternatively, the hold switch 3A may be operated without operating any key on the keyboard circuit 2. In this case, the CPU 11 executes processing for a loop of steps SP11–SP13–SP14–SP15–SP16–SP17 or steps SP11–SP13–SP14–SP18–SP16–SP17, thereby obtaining a state wherein hold data HOLD = 1 has been written in the hold designation register 14A.

However, in order to set HOLD = 0 for the hold data HOLD in the hold designation register 14A, the hold switch 3A may be operated without operating keys on the keyboard circuit 2 until HOLD = 0 is obtained. At this time, the CPU 11 can write hold data HOLD = 0 which represents that the tone generation information of the background musical tone in the TG2 1B is not held in the hold designation register 14A in accordance with a loop of steps SP3–SP11–SP13–SP14–SP18–SP19–SP20.

Figure 8:
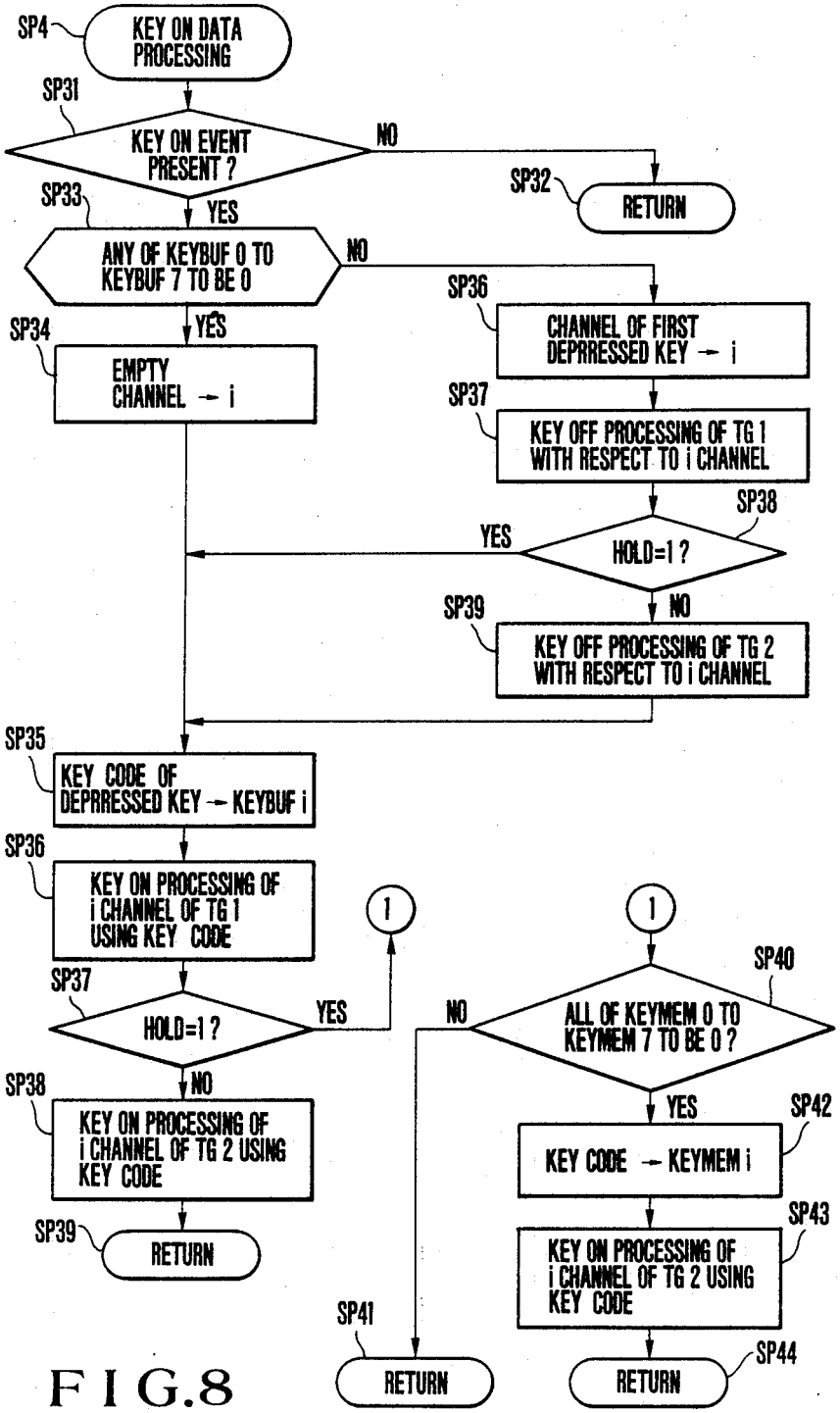
FIG. 8 is a flow chart for explaining a key on data processing routine of FIG. 4.

The key on data processing routine of the main routine (FIG. 4) is executed in accordance with a subroutine shown in FIG. 8.

That is, the CPU 11 starts the key on data processing routine from step SP4, and checks in step SP31 whether a key on event is present. If a performer does not depress any key on the keyboard circuit 2, the flow returns from step SP32 to the main routine.

If the performer depresses any key on the keyboard circuit 2, i.e., if Y in step SP31, the CPU 11 checks in step SP33 whether any of the key code data KEYBUF0 to KEYBUF7 in the key code buffer register 14B is 0. If Y in step SP33, it is determined that any of the eight channels which can simultaneously generate tones is empty. Therefore, the flow advances to step SP34, and the CPU 11 assigns the empty channel as a channel i to be processed. Then, in step SP35, the CPU 11 fetches a key code of the depressed key as the ith key code data KEYBUFi of the key code buffer register 14B.

If N in step SP33, it is determined that key code data are assigned to all the channels. Therefore, the flow advances to step SP36, the CPU 11 designates a channel of a key which is firstly depressed of the 8-channel key code data as the channel i to be processed. Then, in step SP37, the CPU 11 executes key off processing for the TG1 1A with respect to the ith channel.

Subsequently, in step SP38, the CPU 11 checks whether the hold data HOLD stored in the hold designation register 14A is "1".

If N in step SP38, it is determined that the key code data of the ith channel need not be held. Therefore, in step SP39, the CPU 11 executes key off processing for the background musical tone of the TG2 1B, and then the flow advances to step SP35.

If Y in step SP38, it is determined that the hold data HOLD stored in the hold designation register 14A must be held. Therefore, the CPU 11 jumps over step SP39, i.e., does not execute the key off processing for the TG2 1B, and the flow directly advances to step SP35.

Firstly, when an empty channel is present, the CPU 11 immediately assigns a key code to the ith channel in accordance with a loop of steps SP4–SP31–SP33–SP34–SP35. Secondly, when an empty channel is not present, the CPU 11 executes the key off processing for a background musical tone to the ith channel in accordance with a loop of steps SP4–SP31–SP33–SP36–SP37–SP38–SP39–SP35 under the condition that the hold data HOLD is not HOLD = 1 and then assigns a key code to the ith channel. Thirdly, when an empty channel is not present and the hold data HOLD is not HOLD = 1, the CPU 11 assigns key data to the ith channel without executing the key off processing for the background musical tone.

In step SP36, the CPU 11 executes the key on processing for the ith channel of the TG1 1A using the key code data assigned to the ith channel. Then, in step SP37, the CPU 11 checks whether the hold data HOLD stored in the hold designation register 14A is HOLD = 1. If N in step SP37, the flow advances to step SP38, and the CPU 11 executes key on processing for the ith channel in the TG2 1B using the key code data. Thereafter, the flow returns from step SP39 to the main routine.

If Y in step SP37, the flow advances to step SP40, and the CPU 11 checks whether all the key code memory data KEYMEM0 to KEYMEM7 in the key code memory register 14C are "0". If N in step SP37, it is determined that any of keys on the keyboard circuit 2 is depressed and one of key code data of the depressed keys is held. Therefore, the CPU 11 does not execute key on processing for the background musical tone of the TG2 1B and the flow returns from step SP41 to the main routine.

If Y in step SP40, it is determined that all the keys on the keyboard circuit 2 are kept released. At this time, the flow advances to step SP42, and the CPU 11 writes the key code data as the ith key code memory data KEYMEMi of the key code memory register 14C. Then, in step SP43, the CPU 11 executes key on processing for the ith channel of the TG2 1B using the key code data. Thereafter, the flow returns from step SP44 to the main routine.

When all the keys are kept released, a tone of a key which is firstly depressed is held as a background musical tone from the TG2 1B.

Figure 9:
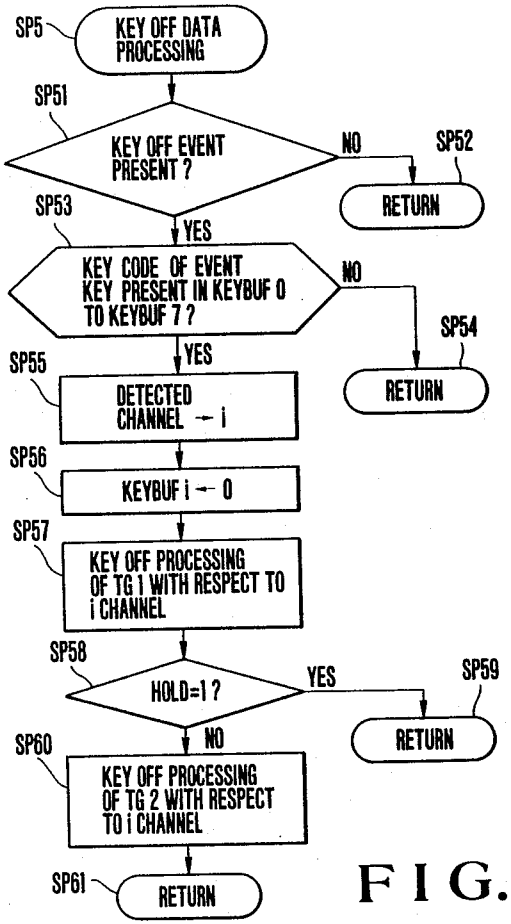
FIG. 9 is a flow chart for explaining a key off data processing routine of FIG. 4.

The key off data processing routine in step SP5 of the main routine in FIG. 4 is executed in accordance with a subroutine shown in FIG. 9.

That is, the CPU 11 starts the key off data processing routine from step SP5, and checks in step SP51 whether a key off event is present.

If N in step SP51, it is determined that a key subjected to the key off event is not present on the keyboard circuit 2. Therefore, the flow returns from step SP52 to the main routine.

If Y in step SP51, it is determined that a released key is present on the keyboard circuit 2. Therefore, the flow advances to step SP53, and the CPU 11 checks whether a key code of the event key is present in the key code data KEYBUF0 to KEYBUF7 in the key code buffer register 14B. If N in step SP53, the flow returns from step SP54 to the main routine.

If Y in step SP53, the flow advances to step SP55, and the CPU 11 designates the channel in which the key off event is generated as a channel i to be processed. Then, in step SP56, the CPU 11 clears the key code data KEYBUFi of the channel to be 0. Thereafter, in step SP57, the CPU 11 executes key off processing for TG1 1A with respect to the ith channel.

Subsequently, in step SP58, the CPU 11 checks whether the hold data HOLD of the hold designation register 14A is HOLD = 1.

If Y in step SP 58, it is determined that a hold mode is designated to the TG2 1B. Therefore, the CPU 11 does not execute the key off processing for the musical tone generated in the TG2 1B with respect to the ith channel, and the flow returns from step SP59 to the main routine.

If N in step SP 58, it is determined that the musical tone of the ith channel need not be held. Therefore, in step SP60, the CPU 11 executes key off processing for the TG2 1B with respect to the ith channel. Then, the flow returns from step SP61 to the main routine.

According to the key off data processing routine in FIG. 9, when a released key is present on the keyboard circuit 2, the CPU 11 executes the key off processing for the main musical tone in the TG1 1A with respect to a channel of a key code of the released key (step SP57), and executes the key off processing for the background musical tone in the TG2 under the condition that the hold data HOLD is HOLD = 0 (step SP60).

Figure 10:
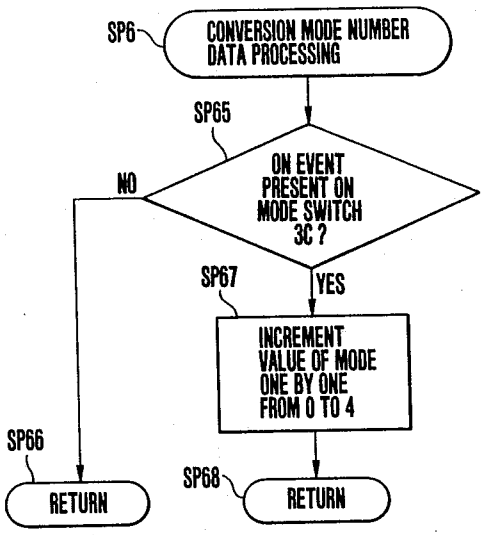
FIG. 10 is a flow chart for explaining a conversion mode number data processing routine of FIG. 4.

The conversion mode number data processing routine in step SP6 of the main routine in FIG. 4 is executed in accordance with a subroutine shown in FIG. 10.

That is, the CPU starts the conversion mode number data processing routine in step SP6, and checks in step SP65 whether an on event is present on the mode switch 3C. If N in step SP65, the flow returns from step SP66 to the main routine.

If Y in step SP66, the flow advances to step SP67, and the CPU 11 adds "+1" to the value of the conversion mode number data MODE in the conversion mode register 14D and rewrites it in the conversion mode register 14D. Thereafter, the flow returns from step SP68 to the main routine.

In this embodiment, the conversion mode number data MODE can take values from "0" to "4". Therefore, whenever the mode switch 3C is turned on, the conversion mode number data MODE of the conversion mode register 14D cyclically changes between MODE = 0 and MODE = 4.

Figure 11:
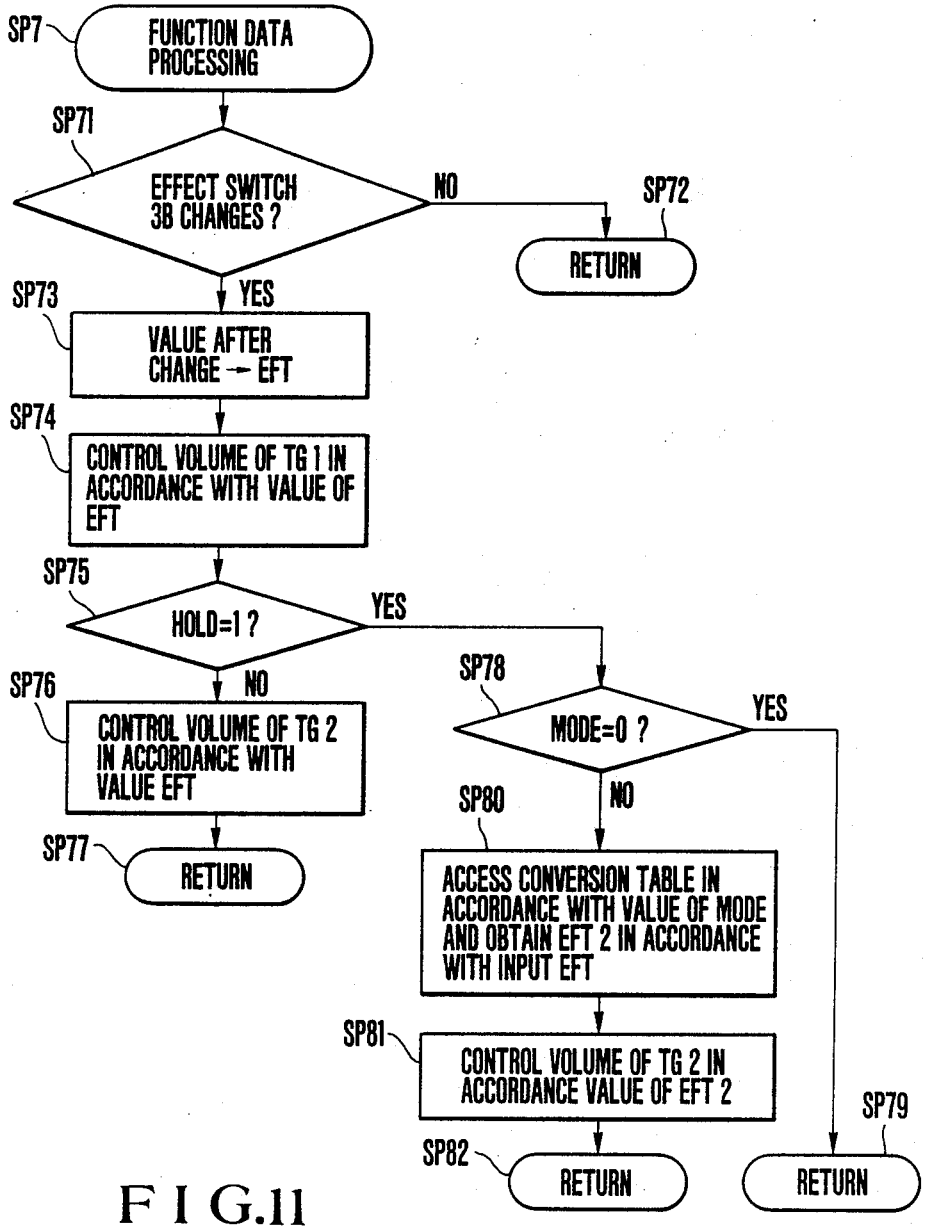
FIG. 11 is a flow chart for explaining a function data processing routine of FIG. 4.

The function data in step SP7 of the main routine in FIG. 4 is executed by a subroutine shown in FIG. 11.

That is, the CPU 11 starts the function data processing routine from step SP7, and checks in step SP71 whether data of the effect switch 3B changes. If N in step SP71, the CPU 11 no longer executes data processing, and the flow returns from step SP72 to the main routine.

If Y in step SP71, the flow advances to step SP73, and the CPU 11 fetches data representing the value of the effect switch 3B after the change in the effect set value register 14E as the effect set value data EFT.

Subsequently, in step SP74, the CPU 11 controls a volume of the main musical tone generated by the TG1 1A in accordance with the value of the effect set value data EFT in the effect set value register 14E. Then, in step SP75, the CPU 11 checks whether the hold data HOLD in the hold designation register 14A is "1".

If N in step SP75, it is determined that the hold mode is not designated. Therefore, the flow advances to step SP76, and the CPU 11 controls a volume of the background musical tone generated by the TG2 1B in accordance with the value of the data EFT in the effect set value register 14E. Thereafter, the flow returns from step SP77 to the main routine.

As a result, the main and background musical tones are generated by the sound system 4 while their volumes are similarly controlled using the effect set value data EFT representing the current set value of the effect switch 3B (steps SP74 and SP76).

If Y in step SP75, it is determined that the performer designates the hold mode in the performance. Therefore, the flow advances to step SP78, and the CPU 11 checks whether the conversion mode number data MODE is MODE = 0.

If Y in step SP78, the flow returns from step SP79 to the main routine. Therefore, the CPU 11 continues the performance operation such that the main and background musical tones are generated in the operation mode wherein a volume is not changed when the effect switch 3B is operated but is maintained at a value immediately before, as described above with reference to FIG. 2A as the conversion data EFT2.

If N in step SP78, the flow advances to step SP80, and the CPU 11 selects one of the conversion mode numbers MODE = 1 to MODE = 4 (FIGS. 2B to 2E) from the table memory 15 in accordance with the conversion mode number data MODE stored in the conversion mode register 14D. The CPU 11 accesses the conversion tables using the effect set value data EFT sequentially fetched in the effect set value register 14E as an address signal to obtain conversion data EFT2, and stores the conversion data EFT2 in the conversion data register 14F.

Subsequently, in step SP81, the CPU 11 reads out the conversion data EFT2 from the conversion data register 14F to control the TG2 1B, thereby controlling a volume of the generated background musical tone.

Musical Tone Generation Operation

With the above arrangement, when the power source is turned on at time $t_0$ in FIGS. 12A to 12E, the CPU 11 starts the main routine from step SP1 (FIG. 4), executes the initialization routine in step SP2, and starts the repeat processing loop LOOP.

At this time, if a performer does not operate the keyboard circuit 2 and the operation switch unit 3, the CPU 11 repeatedly executes the repeat processing loop LOOP through step SP11 (FIG. 5) of the subroutine SP3, step SP31 (FIG. 8) of the subroutine SP4, step SP51 (FIG. 9) of the subroutine SP5, step SP65 (FIG. 10) of the subroutine SP6, and step SP71 (FIG. 11) of the subroutine SP7 without executing other data processing.

In this state, if the performer operates, e.g., a $C_3$ key of the keyboard circuit 2 at time $t_1$ of FIG. 12A, the CPU 11 executes the processing of the key on data processing routine SP4 (FIG. 8).

At this time, all the channels are empty and all the registers in the register unit 14 are cleared. Therefore, the CPU 11 executes processing of steps SP31–SP33–SP34–SP35, thereby writing key code data of the $C_3$ key in the key code buffer register 14B. Then, in step SP36, the CPU 11 transfers the key code data to the TG1 1A to execute key on processing for the TG1 1A so that the TG1 1A generates a main musical tone having a pitch of $C_3$. As a result, unless otherwise the $C_3$ key code data is subjected to key off processing, the TG1 1A is set such that the sound system 4 generates the main musical tone.

Subsequently, in steps SP37 and SP38, the CPU 11 transfers the $C_3$ key code data fetched in the key code buffer register 14B to the TG2 1B to execute key on processing for the TG2 1B so that the TG2 1B generates a pitch of $C_3$. At this time, the TG2 1B is set such that the sound system 4 continuously generates a background musical tone having the pitch of $C_3$ until the TG2 1B is subjected to key off processing.

In this manner, after time $t_1$ of FIGS. 12D and 12E, the TG1 1A and TG2 1B generate the main and background musical tones having the pitch of $C_3$, respectively.

When the on event processing for the $C_3$ key is finished at time $t_1$ of FIG. 12A, the CPU 11 obtains N in step SP31 thereafter, and hence the flow returns from step SP32 to the main routine without executing the key on data processing subroutine. Therefore, the electronic musical instrument EMI continuously, simultaneously generates the main and background musical tones having the pitch of $C_3$.

When the performer operates the hold switch 3A at time $t_2$ of FIG. 12B while he or she operates the $C_3$ key, the CPU 11 detects this in step SP11 (FIG. 5) and executes a hold switch processing routine. That is, in this case, the hold data HOLD of the hold designation register 14A is HOLD = 0. Therefore, the CPU 11 writes hold data HOLD = 1 for inverting the above state in the hold designation register 14A in step SP13, and executes processing in steps SP14, SP15, and SP16, thereby executing the hold on data processing (FIG. 6).

That is, the CPU 11 clears memory data of the key code memory register 14C in steps SP21 and SP22 and holds the key code data KEYBUF0 to KEYBUF7 fetched in the key code buffer register 14B in the key code memory register 14C as the key code memory data KEYMEM0 to KEYMEM7.

As a result, in steps SP13 and SP15 (FIG. 5), hold data HOLD = 1 of logic level "1" which represents the set hold mode is written in the hold designation register 14A. In addition, in step SP23 (FIG. 6), the key code data representing the pitch to be held by the TG2 1B is held in the key code memory register 14C.

When hold data HOLD = 1 is recorded in the hold designation register 14A as described above, even if the performer releases the depressed key on the keyboard circuit 2, the CPU 11 does not interrupt but maintains a tone generation operation of the TG2 1B.

That is, when the performer releases the depressed $C_3$ key on the keyboard circuit 2 at time $t_3$ of FIG. 12A, the CPU 11 detects this in step SP51 of the key off data processing routine (FIG. 9), and executes key off processing for the main musical tone having a pitch of the $C_3$ key set in the TG1 1A in accordance with processing of steps SP53–SP55–SP56–SP57.

In addition, when the CPU 11 determines in step 58 that the hold data HOLD is HOLD = 1, it does not execute key off processing for the TG2 1B in step SP60, and the flow returns from step SP59 to the main routine. Therefore, the CPU 11 holds a state in which the background musical tone having the pitch of the $C_3$ key is set in the TG2 1B.

After time $t_3$, the CPU 11 controls such that the background musical tone having the pitch of the $C_3$ key is continuously generated in the TG2 1B (FIG. 12E) and generation of the main musical tone in the TG1 1A is stopped in accordance with a key release operation on the keyboard circuit 2 (FIG. 12D).

Thereafter, when the performer sequentially depresses $E_3$, $F_3$, $F_3^{\#}$, and $G_3$ keys at times $t_4$, $t_6$, $t_8$, and $t_{10}$, respectively, and releases the keys at times $t_5$, $t_7$, $t_9$, and $t_{11}$, respectively, the CPU 11 repeatedly executes the key on data processing routine (FIG. 8) and the key off data processing routine (FIG. 9) in accordance with an on event and an off event of each key, thereby causing the TG1 1A to sequentially generate main musical tones having pitches of $E_3$, $F_3$, $F_3^{\#}$, and $G_3$. As a result, a main melody is formed by the main musical tones. However, when the hold data HOLD = 1, the CPU detects this in steps SP38 and SP58 and does not execute the key on and key off processing for the TG2 1B in steps SP39 and SP60 so that the flow immediately returns to the main routine. Therefore, the hold state of the background musical tone is maintained.

When the performer operates the hold switch 3A at time $t_{12}$ of FIG. 12B so as to release the hold state, the CPU 11 detects this in step SP11 (FIG. 5). Thereafter, the CPU 11 updates the hold data HOLD in the hold designation register 14A to HOLD = 0 in step SP13, and executes processing in steps SP14, SP18, SP19, and SP20, thereby executing key off processing for the TG2 1B.

In this processing, the CPU 11 checks the condition of the hold data HOLD in step SP18 under the condition that all the key code data KEYBUF0 to KEYBUF7 in the key code buffer register 14B are 0 (i.e., no key is depressed on the keyboard circuit 2) in step SP14 (FIG. 5). Then, the CPU executes the key off processing for the TG2 1B in step SP25 (FIG. 7) under the condition that no key is depressed on the keyboard circuit 2, and executes the clear processing for the key code memory register 14C in step SP26.

In this manner, at time $t_{12}$ of FIG. 12C, the hold data HOLD of the hold designation register 14A falls to HOLD = 0, and the background musical tone having the pitch of $C_3$ generated by the TG2 1B is stopped. Therefore, after time $t_{12}$, the sound system 4 no longer generates the background musical tone which has been held until this moment.

As a result, while neither the main nor background musical tone are generated, depression of the $G_3$ key on the keyboard circuit 2 by the performer at time$_{13}$ of FIG. 12A is waited for.

As described above, with this arrangement, a main musical tone having a pitch designated by key depression on the keyboard circuit 2 as a pitch designating means is generated, and a background musical tone is generated or stopped by operating the hold switch 3A as a pitch holding means by a performer. Therefore, by adding a simple operation of the hold switch 3A to an operation of the keyboard circuit 2, the background musical tone can be added to the main musical tone in accordance with the performer's need. As a result, a more expressive performance tone can be generated.

In this case, the CPU 11 can control the main and background musical tones in the conversion mode number data processing routine SP6 (FIG. 10) and the function data processing routine SP7 (FIG. 11) in relation to the effect switch 3B as a musical tone control means if necessary.

First, when the performer operates the effect switch 3B while the hold mode is not set, the CPU 11 detects this in step SP71 (FIG. 11), and sets a volume of the TG1 1A in steps SP73 and SP74 and that of the TG2 1B in steps SP75, SP76, and SP77.

In this manner, by operating the effect switch 3B as needed, the performer can control the volumes of the main and background musical tones generated by the TG1 1A and TG2 1B substantially in proportional to an operation amount of the effect switch 3B. As a result, a desired effect can be easily added to the musical tones generated by the sound system 4.

In addition, when the hold mode is set, the CPU 11 executes the processing in steps SP75, SP78, SP80, SP81, and SP82, thereby selectively controlling the volume of the TG2 1B in accordance with the performer's need.

The conversion mode can be selected by selecting one of the conversion modes described above with reference to FIGS. 2B to 2E by the performer in the conversion mode data processing routine (FIG. 10).

That is, when the conversion mode number data MODE is selected to be MODE = 1 (FIG. 2B), the CPU 11 controls volumes of the musical tones such that the background musical tone changes in accordance with a change in main musical tone generated when the effect switch 3B is operated.

When the conversion mode number data MODE is selected to be MODE = 2 (FIG. 2C), the CPU 11 controls volumes of the musical tones such that when the main musical tone linearly changes to be loud, the background musical tone is suppressed so as not to be emphasized too much.

When the conversion mode number data MODE is selected to be MODE = 3 (FIG. 2D), the CPU 11 controls volumes of the musical tones such that when the volume of the main musical tone is increased, that of the background musical tone is decreased so as to emphasize the main musical tone while a total volume of the musical tones generated from the sound system 4 is not changed.

When the conversion mode number data MODE is selected to be MODE = 4 (FIG. 2E), the CPU 11 controls volumes of the musical tones such that the background musical tone is generated in a volume larger than a change in the main musical tone by an amount of offset so as to be emphasized.

By controlling the musical tones in this manner, a desired effect according to the performer's need can be added to the musical tones by simply operating the effect switch 3B. As a result, more expressive musical tones can be generated.

The present invention is not limited to the above embodiment but can be variously modified and changed without departing from the spirit and scope of the present invention.

(1) In the above embodiment, the first tone generator (TG1) 1A for generating the main musical tone and the second tone generator (TG2) 1B for generating the background musical tone can simultaneously generate a plurality of, e.g., eight tones (i.e., TG1 1A and TG2 1B have tone generation systems of eight channels). However, the number of musical tones which can be simultaneously generated is not limited to eight. For example, when the number is one or more other than eight, the same effect as described above can be obtained.

(2) Tone generation channels may be assigned to the TG1 1A and TG2 1B as follows. That is, as shown in FIG. 13, the 0th and 1st channels are assigned to the TG2 1B, and the remaining 2nd to 7th channels are assigned to the TG1 1A. When a plurality of (maximally, eight) keys are depressed on the keyboard circuit 2, key codes of the depressed keys are assigned to empty channels from the 0th channel side. In the hold mode, only the key codes in the 0th and 1st channels are held, and key codes of keys operated in this state are assigned to the 2nd to 7th channels.

With this arrangement, two tones of the key codes assigned to the 0th and 1st channels are generated as background musical tones having tone colors determined by the TG2 1B, and tones of the key codes assigned to the 2nd to 7th channels are generated as main musical tones having tone colors determined by the TG1 1A. In the hold mode, while pitches of the background musical tones of the 0th and 1st channels are held, the main musical tones of the 2nd to 7th channels are changed in accordance with key depression on the keyboard circuit 2.

(3) A channel to be held when is operated need not be fixed but may be rewritten. In this case, the same effect as descried above can also be obtained.

(4) In the above embodiment, in order to release a hold state when tones are generated in the hold mode, all the keys must be released (step SP14 (FIG. 5)). However, if a performer needs to release the hold mode by operating the hold switch 3A, the hold state may be unconditionally released.

(5) In the above embodiment, the conversion data as shown in FIGS. 2A to 2E are prepared as conversion tables. However, the conversion tables are not limited to these tables but may be variously modified.

(6) In the above embodiment, the TG1 1A and TG2 1B for generating the main and background musical tones are independently constituted as hardware. However, even if a single tone generator may be time-divisionally operated to generate the main and background musical tone signals STG1 and STG2, the same effect as described above can be obtained.

(7) In the above embodiment, the present invention is applied to a so-called keyboard type electronic musical instrument having the keyboard circuit 2 as a pitch designating means. However, the present invention may be widely applied to electronic musical instruments having a pitch designating means other than a keyboard such as a music synthesizer of wind instrument type.

(8) In the above embodiment, the TG1 1A for generating the main musical tone and TG2 1B for generating the background musical tone generate musical tones generate different tone colors. However, even if tone generators may generate musical tones having substantially the same tone color, the same effect as described above can be obtained.

(9) In the above embodiment, each of the TG1 1A for generating the main musical tone and the TG2 1B for generating the background musical tone is provided as a single system. However, even if a plurality of either or both of the tone generators may be provided, the same effect as described above can be obtained.

(10) In the above embodiment, in the function data processing (FIG. 11), musical tones are controlled using a volume control signal input from the effect switch 3A. However, the musical tones may be controlled by controlling other parameters such as a tone color and a pitch.

(11) In the above embodiment, the effect switch 3B is used as a musical tone controlling operation member. However, as the musical tone controlling operation member, a pitch bender, a modulation wheel, a foot pedal, an after touch operation member, or the like may be used.

As has been described above, according to the present invention, a main musical tone having a pitch designated by a pitch designating means is generated, and when a designation signal is supplied from a pitch hold designating means, a background musical tone having a pitch corresponding to the input designated by the pitch designating means is simultaneously generated. Therefore, by a simple operation of a performer, a more expressive musical tone can be generated.

In addition, according to the present invention, the main musical tone is controlled in accordance with an output from a musical tone control means, and the background musical tone can be controlled after a control signal from the musical tone control means is converted in a conversion mode wherein a performer can selectively convert the signal. As a result, a more expressive musical tone can be generated.

Another embodiment of the present invention will be described below with reference to the accompanying drawings.

Overall Arrangement

Figures 14, 15:
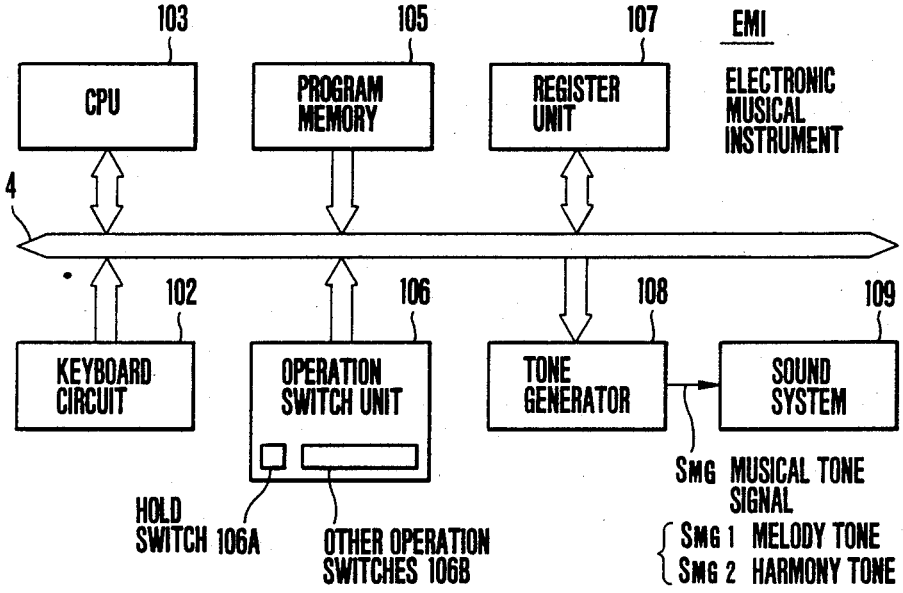
FIG. 14 is a block diagram showing an overall arrangement of an electronic musical instrument according to another embodiment of the present invention.
FIG. 15 is a view showing a relationship between pitches assigned to keys and key code.

In FIG. 14, reference symbol EMI denotes an entire electronic musical instrument having a keyboard circuit 102 as a pitch designating means. When a performer operates a key, a central processing unit (CPU) 103 reads out information about the operated key from the keyboard circuit 102 through a bus 104 and executes data processing in accordance with program data stored in a program memory 105 under performance conditions set by an operation switch unit 106. Thereafter, the processed data is fetched in a register unit 107.

The CPU 103 forms musical tone data using the data fetched in the register unit 107 and supplies the musical tone data to a tone generator 108. The tone generator (to be referred to as a TG hereinafter) 108 forms a musical tone signal $S_{MG}$, and the musical tone signal $S_{MG}$ is converted into a musical tone in a sound system 109.

The operation switch unit 106 has a hold switch 106A and other operation switches 106B. When a performer operates the hold switch 106A, a duet mode can be input and designated.

In this embodiment, the TG 108 can time-divisionally generate musical tone signals of a plurality of, e.g., two tones by a tone generation system of time-divisional two channels. Therefore, a melody tone is generated in accordance with a musical tone signal of the first channel CH1, and at the same time a harmonic tone having a pitch difference with respect to the melody tone is generated by the second channel CH2, thereby generating the tones in a duet mode. In this case, a trio background musical tone, i.e., a background musical tone having three or more tones can be generated.

In this embodiment, the musical tone signals $S_{MG1}$ and $S_{MG2}$ of the first and second channels CH1 and CH2 have different tone colors.

When the CPU 103 commands key on data processing or key off data processing for the first and second channels CH1 and CH2, the TG 108 generates or stops generating a musical tone having a pitch of a key subjected to the key on or key off data processing.

As shown in FIG. 15, keys $C_1$, $C_1^{\#}$, ..., $C_2$, ..., $C_3$, ..., $C_4$, ..., $C_5$, ..., $C_6$ having successive pitches of the keyboard circuit 102 are assigned with key codes 24, 25, ..., 36, ..., 48, ..., 60, ..., 72, ..., 84 representing the pitches by halftone numbers, respectively. Therefore, the CPU 3 executes processing for input key code data and tone generation processing for the TG108 using the key codes represented by the halftone numbers.

Figure 16:
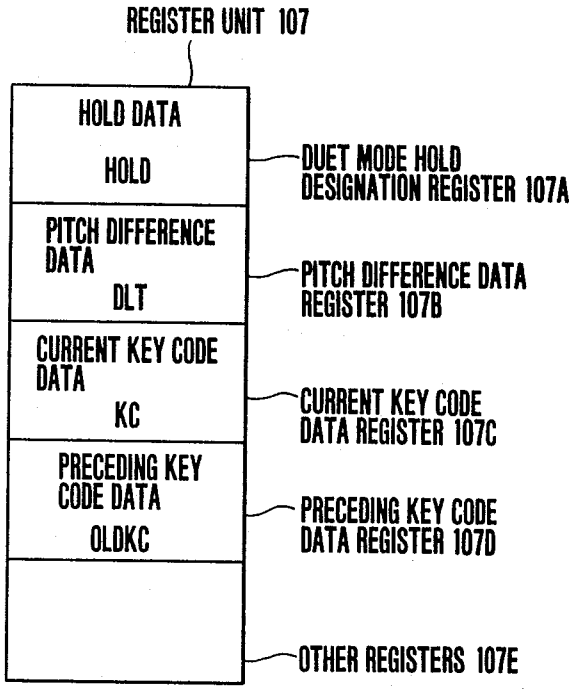
FIG. 16 is a schematic view showing in detail an arrangement of a register unit in FIG. 14.

The register unit 107 including a memory means for storing data used for duet performance is arranged as shown in FIG. 16.

A duet mode hold designation register 107A stores hold data HOLD for designating whether the TG 108 is maintained in a duet mode (this is called a hold state) or set in a unison mode. When the duet mode is to be held, the hold data HOLD goes to logic level "1", and when the unison mode is to be set, it goes to logic level "0".

In this embodiment, in the duet mode, the TG 108 is controlled such that pitches of the musical tone signals $S_{MG1}$ and $S_{MG2}$ having different tone colors are changed in accordance with key depression on the keyboard circuit 102 while a pitch difference set by a performer is maintained. As a result, a melody tone is formed by the first channel musical tone signal $S_{MG1}$, and a harmonic tone is formed by the second channel musical tone signal $S_{MG2}$.

In the unison mode wherein the hold data HOLD is "0", the TG 108 is controlled such that pitches of the first and second musical tone signals $S_{MG1}$ and $S_{MG2}$ having different tone colors are identically changed in accordance with key depression on the keyboard circuit 102. As a result, a performance tone having an ensemble effect is generated by the sound system 109.

A pitch difference data register 107B stores pitch difference data DLT representing a pitch difference of the harmonic tone with respect to the melody tone in the duet mode. The pitch difference data DLT is represented by a halftone number as a key code difference and set within the maximum range of −60 to +60.

A current key code data register 107C stores current key code data KC representing a key code of a key which is currently depressed.

A preceding key code data register 107D stores preceding key code data OLDKC consisting of key code data input by a depression preceding the current key depression. The CPU 103 calculates a difference between the preceding key code data OLDKC of the preceding key code data register 107D and the current key code data KC of the current key code data register 107C, thereby calculating the pitch difference data DLT.

Other registers 107E include registers for storing data concerning the duet or unison mode other than the above data. The CPU 103 executes calculations for generating musical tones using the other registers 107E if necessary.

Musical Tone Generation Processing

Figure 17:
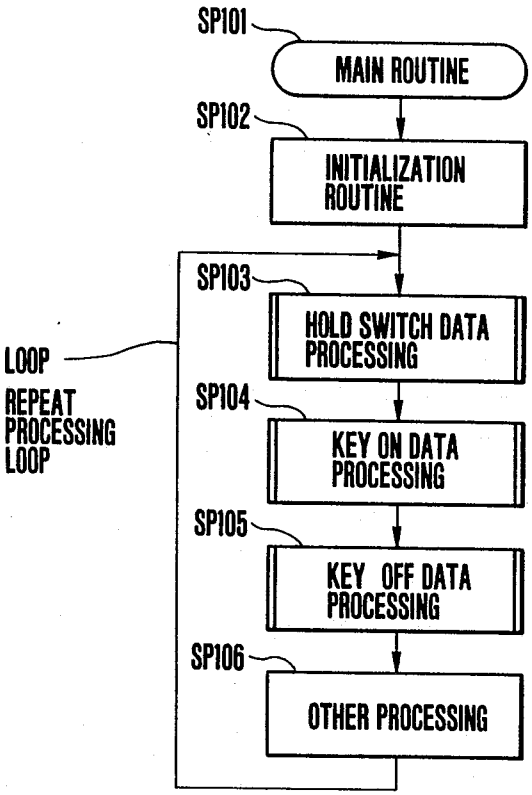
FIG. 17 is a flow chart for explaining a main routine of a musical tone generation processing program of a CPU 103 in FIG. 14.

The CPU 103 executes a musical tone generation processing program shown by a main routine of FIG. 17 and causes the sound system 109 to generate a performance tone consisting of a melody tone and a harmonic tone in the duet or unison mode in accordance with an operation of a performer.

That is, the CPU 103 starts the musical tone generation processing program from step SP101, and executes an initialization routine in step SP102. In this initialization routine, data in the entire electronic musical instrument EMI, including data of the register unit 107, are cleared to be set in an initialized state.

Thereafter, in step SP103, the CPU 103 executes a hold switch data processing routine to process the hold data HOLD representing a state of the hold switch 106A. Thereafter, in step SP104 or SP105, the CPU 103 executes a key on data processing routine or a key off data processing routine when any of keys on the keyboard circuit 102 is depressed or released (this operation is called a key on event or a key off event).

Subsequently, the CPU 103 executes the other processing in step 106 to process data such as tone color switching data, and the flow returns to step SP103.

Thereafter, the CPU executes calculation of a repeat processing loop LOOP of steps SP103–SP104–SP105–SP106–SP103 in response to predetermined clocks. Therefore, whenever the performer operates any of the keys on the keyboard circuit 102 or the operation switch unit 106, the CPU 103 executes processing of data corresponding to the operated key.

Figure 18:
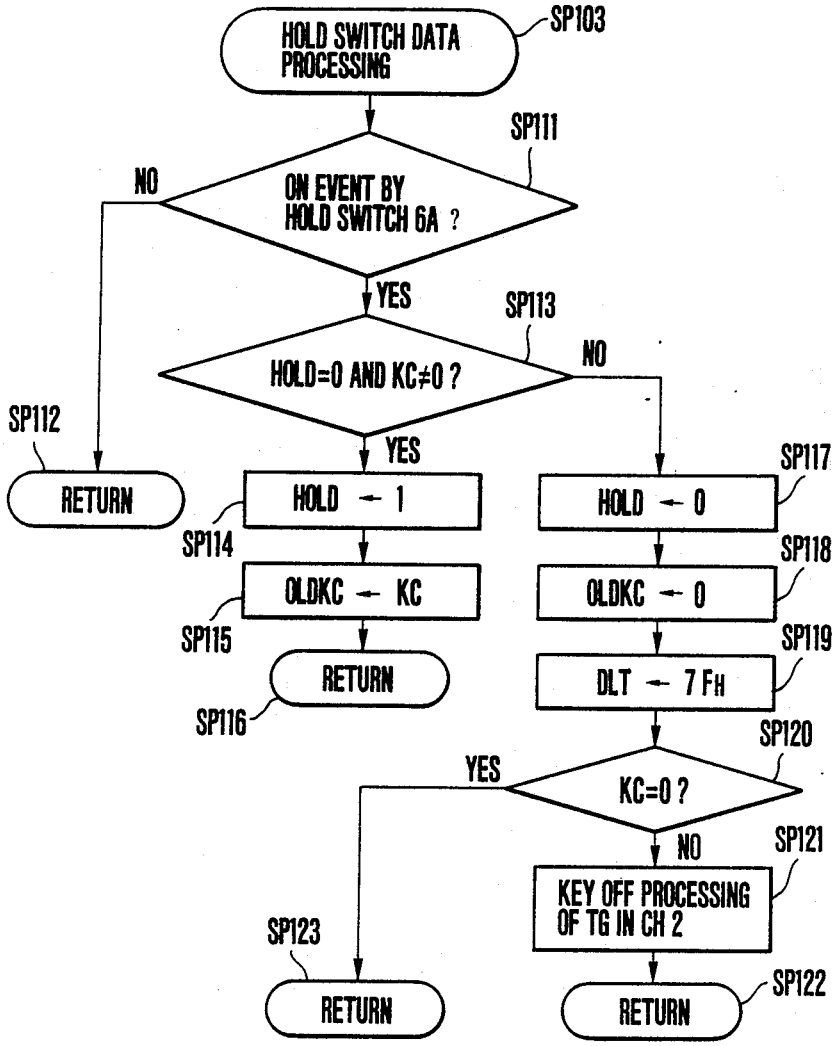
FIG. 18 is a flow chart for explaining in detail steps of a hold switch data processing routine (SP103) of FIG. 17.

When the CPU 103 starts the hold switch data processing routine in step SP103, the CPU 103 checks in step SP111 of FIG. 18 whether an on event is generated by the hold switch 106A. If N (NO) in step SP111, the CPU 103 does not execute the hold data processing program, and the flow immediately returns from step SP112 to the main routine.

If Y (YES) in step SP111, it is determined that the hold switch 106A is depressed by the performer. Therefore, the CPU 103 detects this, and the flow advances to step SP113.

In step SP113, the CPU 103 checks whether the hold data HOLD in the duet mode hold designation register 107A is "0" and the current key code data KC in the current key code data register 107C is other than "0". If Y in step SP113, it is determined that the TG 108 operates in the unison mode (i.e., the hold data HOLD is HOLD = 0) because the performer operates the keys on the keyboard circuit 102 (i.e., the current key code data KC is not "0"). Therefore, the flow advances to step SP114, and the CPU 103 determines that the duet mode is designated by an on event of the hold switch 106A and writes HOLD = 1 as the hold data HOLD in the duet mode hold designation register 107A.

In this manner, hold data HOLD = 1 representing that the duet mode is designated is held in the duet mode hold designation register 107A. Then, in step SP115, the CPU 103 transfers the current key code data KC from the current key code data register 107C to the preceding key code data register 107D. As a result, the transferred current key code data KC is held as the preceding key code data OLDKC.

When the CPU 103 finishes the processing program for setting the duet mode, the flow returns from step SP116 to the main routine.

If N in step SP113, it is determined that a key on the keyboard circuit 102 is kept released (i.e., KC = 0) or the duet mode is maintained (i.e., HOLD = 1) even if a key is depressed (i.e., KC ≠ 0). In this case, the flow advances to step SP117, and the CPU 103 writes HOLD = 0 as the hold data HOLD in the duet mode hold designation register 107A. Thereafter, the flow advances to step SP118, and the CPU 103 resets the preceding key code data OLDKC in the preceding key code data register 107D to OLDKC = 0. Then, in step SP119, the CPU 103 writes unset data $7F_H$ as the pitch difference data DLT in the pitch difference data register 107B.

In this case, since pitch difference data DLT = $7F_H$ is written, it is determined that the performer does not set the pitch difference data (i.e., the data is in an unset state).

Thereafter, the flow advances to step SP120, and the CPU 103 checks whether the current key code data KC fetched in the current key code data register 107C is "0". If N in step SP120, it is determined that any of keys on the keyboard circuit 102 is depressed. Therefore, the flow advances to step SP121, and the CPU 103 executes key off data processing for the second channel CH2 of the TG 108. Then, the flow returns from step SP122 to the main routine.

If Y in step SP120, it is determined that no key is depressed on the keyboard circuit 102. Therefore, the flow returns from step SP123 to the main routine.

That is, in the hold data processing routine, when an on event is generated on the hold switch 106A in the unison mode, the CPU 103 sets HOLD = 1 as the HOLD in step SP114 to command that the duet mode is to be held. However, when an on event is generated on the hold switch 106A in the duet mode, the CPU sets HOLD = 0 as the hold data HOLD in step 117 to command that the unison mode is to be held.

Figure 19:
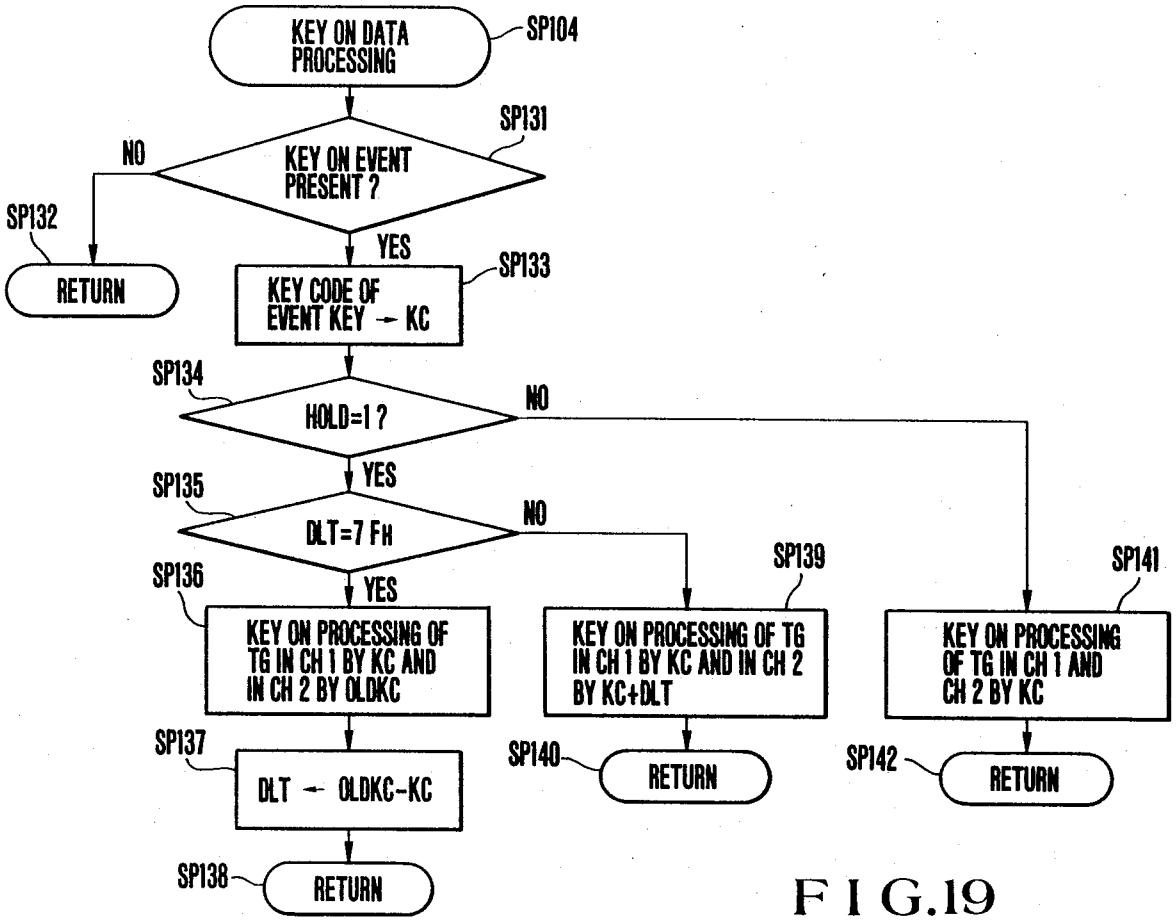
FIG. 19 is a flow chart for explaining in detail steps of a key on data processing routine (SP104) of FIG. 17.

The key on data processing in step SP104 of the main routine is executed in accordance with a subroutine in FIG. 19.

That is, the CPU 103 starts the processing program in step SP104, and checks in step SP131 whether a key on event is present. If N in step SP131, it is determined that no key is depressed on the keyboard circuit 102. Therefore, the flow returns from step SP132 to the main routine.

If Y in step SP131, it is determined that any of keys is depressed on the keyboard circuit 102. Therefore, in step SP133, the CPU 103 fetches a key code of the event key as the current key code data KC in the current key code data register 107C.

Subsequently, the flow advances to step SP134, and the CPU 103 checks whether the hold data HOLD of the duet mode hold designation register 107A is HOLD = 1. If Y in step SP134, it is determined that a performer designates that the TG 108 generates a tone in the duet mode. Therefore, the flow advances to step SP135, and the CPU 103 checks whether the pitch difference data DLT of the pitch difference data register 107B is the unset data $7F_H$.

If Y in step SP135, it is determined that when the hold data is processed by the hold data processing routine described above with reference to FIG. 18, DLT = $7F_H$ is kept written as the pitch difference data DLT in step SP119. Therefore, the flow advances to step SP136, and the CPU 103 executes key on data processing so that the first channel of the TG 108 generates the musical tone signal $S_{MG1}$ using the current key code data KC. At the same time, the CPU 103 executes key on data processing so that the second channel CH2 of the TG 108 generates the musical tone signal $S_{MG2}$ using the preceding key code data OLDKC.

In this state, the performer can listen to a melody tone generated by the currently-depressed key and a harmonic tone generated by the precedingly-depressed key and therefore can check a pitch difference between the melody and harmonic tones generated in the duet mode.

Subsequently, in step SP137, the CPU 103 calculates a difference between the preceding key code data OLDKC and the current key code data KC (i.e., OLDKC - KC) and writes a calculation result in the pitch difference data register 107B as the pitch difference data DLT. Then, the flow returns from step SP138 to the main routine.

In this manner, pitch difference data DLT = OLDKC - KC determined by a set operation of the performer is set in the pitch difference data register 107B in place of the unset data $7F_H$ set in step SP119. For this reason, thereafter, the harmonic tone having the above pitch difference may be generated using the pitch difference data DLT.

When the CPU 103 restarts the key on data processing routine in step SP104 by the repeat processing loop LOOP of the main routine, N is obtained in step SP135 (FIG. 19). Therefore, the flow advances to step SP139.

In step SP139, the CPU 103 executes the key on data processing for the musical tone signal $S_{MG1}$ of the first channel CH1 of the TG 108 using the current key code data KC, and executes the key on data processing for the second channel CH2 using a sum of the current key code data KC and the pitch difference data DLT, i.e., key code data of KC + DLT, thereby controlling musical tone generation. Thereafter, the flow returns from step SP140 to the main routine.

As a result, the first channel CH1 of the TG 108 generates a melody tone which constitutes a main melody in accordance with a designation order of keys currently depressed on the keyboard circuit 102, and its second channel CH2 generates a harmonic tone having a pitch higher or lower than that of each depressed key on the keyboard circuit 2 by an amount of the pitch difference data DLT. Therefore, a performance tone can obtain a duet effect as a whole.

If N in step SP134 (FIG. 19), it is determined that the performer does not designate the duet mode. In this case, in step SP141, the CPU 103 executes key on data processing for the first and second channels CH1 and CH2 of the TG 108 using the same current key code data KC. Thereafter, the flow returns from step SP142 to the main routine. As a result, the TG 108 generates melody and harmonic tones having the same pitch in accordance with a key code of a key depressed on the keyboard circuit 102, thereby obtaining a performance tone having a unison effect.

Figure 20:
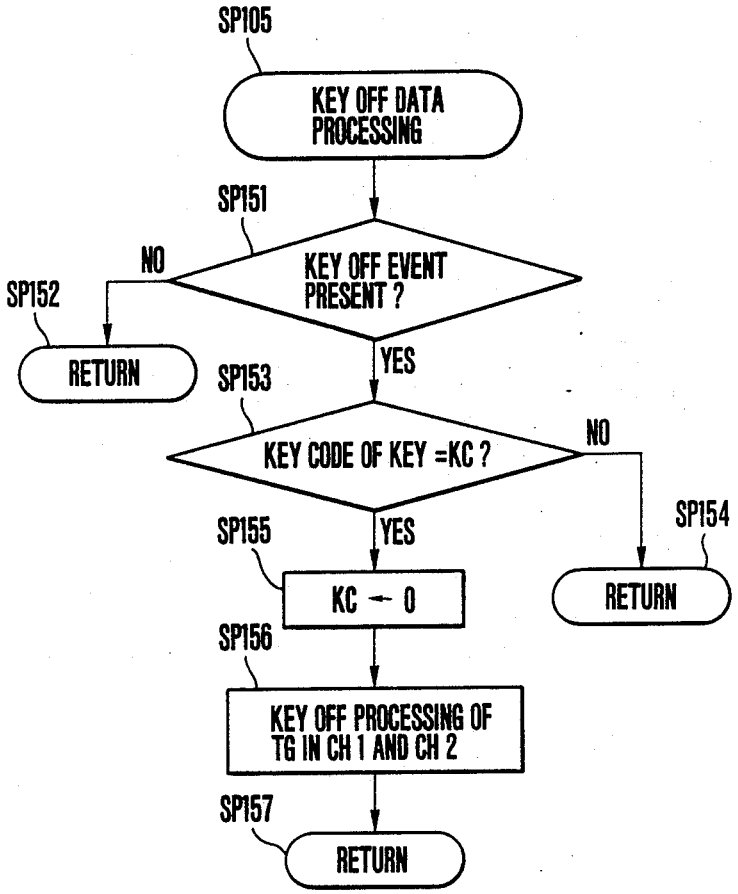
FIG. 20 is a flow chart for explaining in detail steps of a key off data processing routine (SP105) of FIG. 17.

The key off data processing in step SP105 of the main routine is executed in accordance with a subroutine shown in FIG. 20. That is, the CPU 103 starts the key off data processing routine in step SP105, and checks in step 151 whether a key off event is present. If N in step SP151, the flow returns from step SP152 to the main routine.

If Y in step SP151, it is determined that a key having released by a performer is present on the keyboard circuit 102. Therefore, the flow advances to step SP153, and the CPU 103 checks whether a key code of the key off event key coincides with the current key code data KC fetched in the current key code data register 107C.

If N in step SP153, it is determined that the key off event key differs from a key whose tone is currently generated. In this state, the key off data processing need not be executed (because the key is no longer set in the tone generation state), and therefore the flow returns from step SP154 to the main routine.

If Y in step SP153, it is determined that a key having the same key code as that of a melody tone which is currently generated is released. Therefore, the flow advances to step SP155, and the CPU 103 clears the current key code data KC of the current key code data register 107C to be KC = 0. Then, in step SP156, the CPU 103 executes key off data processing for the first and second channels CH1 and CH2 of the TG 108. Thereafter, the flow returns from step SP157 to the main routine.

As a result, the TG 108 is controlled not to generate either melody or harmonic tone.

Tone Generation Operation

With the above arrangement, when the power source is turned on at time $t_0$ of FIGS. 21A to 21H, the CPU 103 executes the initialization routine in step SP102 of the main routine (FIG. 17) of the musical tone generation processing program, and then starts the repeat processing loop LOOP.

At this time, the registers in the register unit 107 are initialized. Since the keyboard circuit 102 and the operation switch unit 106 are not operated yet, the hold data HOLD is at level "0" (FIG. 21C), and the first and second channels CH1 and CH2 of the TG 108 are in a key off data processing state (FIGS. 21D and 21E).

In this case, Ns are obtained in steps SP111, SP131, and SP151 when the CPU 103 executes the processing routines in steps SP103, SP104, and SP105, respectively. Therefore, the CPU 103 substantially does not execute any of the above subroutines, and the flow immediately returns to the main routine. As a result, the first and second channels CH1 and CH2 of the TG 108 do not generate melody and harmonic tones and wait until a performer operates the keyboard circuit 102 or the operation switch unit 106.

Figures 21A, 21B, 21C, 21D, 21E, 21F, 21G, 21H:
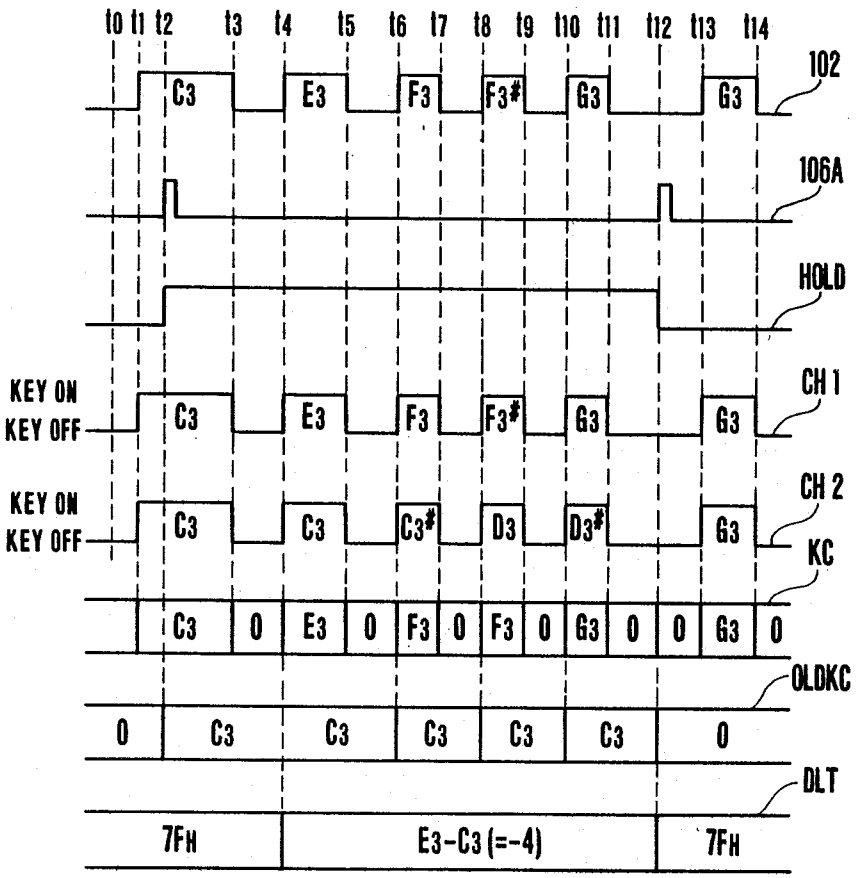
FIGS. 21A to 21H are timing charts for explaining an operation.

When the performer depresses a $C_3$ key on the keyboard circuit 102 at time $t_1$ of FIG. 21A, the CPU 103 detects this in step SP131 of the key on data processing routine (FIG. 19). Subsequently, the CPU 103 sequentially executes processing in steps SP133, SP134, SP141, and SP142, thereby fetching a key code of the event key in the current key code data register 107C as current key code data KC (FIG. 21F), and then executes key on data processing for the first and second channels CH1 and CH2 of the TG 108 using the current key code data KC (FIGS. 21D and 21E).

As a result, the TG 108 causes the sound system 109 to generate melody and harmonic tones having a pitch of the depressed $C_3$ key in the unison mode.

In this state, when the performer operates the hold switch 106A at time $t_2$ of FIG. 21B, the CPU 103 detects this in step SP111 of the hold data processing routine (FIG. 18). Subsequently, the CPU 103 sequentially executes processing in steps SP113, SP114, SP115, and SP116, thereby writing HOLD = 1 in the duet mode hold designation register 107A as the hold data HOLD (FIG. 21C). At the same time, the CPU 103 transfers the current key code data KC from the current key code data register 107C to the preceding key code data register 107D and holds the data as the preceding key code data OLDKC (FIG. 21G).

As a result, HOLD = 1 representing the duet mode is written in the duet mode hold designation register 107A by the CPU 103.

Thereafter, when the performer release the $C_3$ key on the keyboard circuit 102 at time $t_3$ of FIG. 21A, the CPU 103 detects this in step SP151 of the key off data processing routine (FIG. 20). The CPU 103 sequentially executes processing in steps SP153, SP155, SP156, and SP157, and determines that a key code of the key off event key is the same as the current key code data KC. Thereafter, the CPU 103 writes KC = 0 in the current key code data register 107C as the current key code data KC, and executes key off data processing for the first and second channels CH1 and CH2 of the TG 108. Then, the flow returns from step SP157 to the main routine.

As a result, the preceding key code data OLDKC is held in the preceding key code data register 107D (FIG. 21G). Thereafter, when the performer operates an $E_3$ key on the keyboard circuit 102 at time $t_4$ (FIG. 21A), the CPU 103 calculates the pitch difference data DLT (FIG. 21H) in the key on data processing routine (FIG. 19).

That is, when the performer depresses the $E_3$ key at time $t_4$ of FIG. 21A, the CPU 103 detects this key on event in step SP131 of the key on data processing routine. The CPU 103 sequentially executes processing in steps SP133, SP134, SP135, SP136, SP137, and SP138, thereby writing a key code of the key on event key in the current key code data register 107C as the current key code data KC (FIG. 21F).

In this case, since the unset data $7F_H$ is written in the pitch difference data register 107B in the initialization routine (FIG. 21H), the CPU 103 obtains Y in stp SP135. Therefore, the CPU 103 executes key on data processing for the first channel CH1 of the TG 108 using the current key code data KC in the current key code data register 107C (FIG. 21D), and executes key on data processing for the second channel CH2 using the preceding key code data OLDKC of the preceding key code data register 107D (FIG. 21E). In addition, in step SP137, the CPU 103 calculates the pitch difference data DLT and stores the data in the pitch difference data register 107B (FIG. 21H).

In this manner, the CPU 103 causes the TG 108 to generate a melody tone having a pitch of the $E_3$ key which is currently operated and a harmonic tone having a pitch of the $C_3$ key input by a preceding key operation. At the same time, the CPU 103 causes the pitch difference data register 107B to hold the pitch difference data DLT representing a difference between the two key codes.

Thereafter, when the performer releases the $E_3$ key at time $t_5$ of FIG. 21A, the CPU 103 detects this in step SP151 of the key off data processing routine (FIG. 20) The CPU 103 resets the current key code data KC representing the $E_3$ key to be KC = 0, and then stops tone generation operations of the first and second channels CH1 and CH2 of the TG 108.

When the performer depresses an $F_3$ key on the keyboard circuit 102 at time $t_6$ of FIG. 21A, the CPU 103 detects this in step SP131 of the key on data processing routine (FIG. 19). Thereafter, the CPU 103 sequentially executes processing in steps SP133, SP134, SP135, SP139, and SP140, thereby writing a key code of the $F_3$ key in the current key code data register 107C as the current key code data KC.

At this time, hold data HOLD = 1 is held in the duet mode hold designation register 107A, and pitch difference data DLT = $E_3 - C_3$ (= −4) is held in the pitch difference data register 107B. Therefore, the CPU 103 executes key on data processing for the first channel CH1 of the TG 10 using a pitch of the current key code data KC, and executes key on data processing for the second channel CH2 thereof using a pitch of the key code of KC + DLT.

In this case, the pitch difference data DLT consists of data DLT = $E_3 - C_3$ (= −4) fetched in the pitch difference data register 107B in step SP137 in the key on event at time $t_4$ of FIG. 21A.

Therefore, the sound system 109 generates a harmonic tone having a pitch lower than that of the $F_3$ key of the melody tone by halftone number 4 (i.e., $C_3^{\#}$).

As a result, a duet effect with a pitch difference of the halftone number 4 is obtained in a performance tone.

Similarly, when the performer depresses $F_3^{\#}$ and $G_3$ keys at times $t_8$ and $t_{10}$ of FIG. 21A and releases the keys at times $t_9$ and $t_{11}$, respectively, the CPU 103 detects an key on event in step SP131 of the key on data processing routine (FIG. 19) whenever the $F_3^{\#}$ or $G_3$ key is depressed. The CPU 103 sequentially executes processing in steps SP133, SP134, SP135, SP139, and SP140, thereby controlling the TG 108 to generate harmonic tones having pitches with a pitch difference of the halftone number 4, i.e., pitches of $D_3$ and $D_3^{\#}$ simultaneously with a melody tone having pitches of $F_3^{\#}$ and $G_3$ in the duet mode.

In this state, when the performer operates the hold switch 106A at time$_{12}$ of FIG. 21B, the CPU 103 detects an on event of the hold switch 16A in step SP111 of the hold data processing routine (FIG. 18), and sequentially executes processing in steps SP113, SP117, SP118, SP119, SP120, and SP123. As a result, the CPU 103 writes hold data HOLD = 0 in the duet mode hold designation register 107 in step 117, writes preceding key code data OLDKC = 0 in the preceding key code data register 107D in step SP118, and writes unset data $7F_H$ in the pitch difference data register 107B as the pitch difference data DLT.

In this case, the registers 107A, 107B, 107C, and 107D of the register unit 107 are reset in a state similar to the initialized state, thereby releasing the duet mode and setting the unison mode. Thereafter, when the performer depresses and releases the $G_3$ key on the keyboard circuit 102 at times 13 and 14, respectively, the CPU 103 controls the first and second channels CH1 and CH2 of the TG 108 as described above with reference to time $t_1$, so that melody and harmonic tones having the same pitch of $G_3$ are generated.

With the above arrangement, in order to switch the unison mode to the duet mode, the performer need only operate the hold switch 106A while depressing keys on the keyboard circuit 102 so that pitch difference data DLT is set in the pitch difference data register 107B. As a result, a harmonic tone having a pitch difference with respect to a melody tone by an amount corresponding to the pitch difference data DLT can be generated simultaneously with the melody tone.

In order to switch the duet mode to the unison mode, the performer need only temporarily stop operating keys on the keyboard circuit 102 and operate the hold switch 106A so that the pitch difference data DLT held in the pitch difference data register 107B is cleared. As a result, a harmonic tone having the same pitch as that of a melody tone can be generated.

In this manner, when the duet mode is to be switched to the unison mode or vice versa as needed, a performer can arbitrarily set a value of the pitch difference data DLT by selecting a key to be operated. As a result, a more expressive performance tone can be generated.

The present invention is not limited to the above embodiment but can be variously modified and changed without departing from the spirit and scope of the present invention.

(1) In the above embodiment, the tone generator (TG) 108 generates a monophonic tone as each of melody and harmonic tones. However, a polyphonic tone of tones may be generated as the melody and/or harmonic tone.

In this case, in the hold data processing routine in step SP103, the CPU 103 stores key codes of a plurality of depressed keys in the current key code data register 107C. Then, the CPU 103 calculates a pitch difference between the key codes of the above plurality of depressed keys and those of a plurality of keys designated by key depression thereafter and holds the pitch differences in the pitch difference data register 107B as pitch difference data DLT. As a result, harmonic tones having the pitch differences set with respect to the plurality of keys operated by the performer are generated using the pitch difference data DLT in the duet mode.

For example, when the E and G keys are depressed on the keyboard circuit 102 and the hold switch 106A is operated, the CPU 103 sets the duet mode in which a pitch difference of "+1" (higher by only a halftone) is held as pitch difference data DLT. In this duet mode, when the performer depresses the C key and a plurality of, e.g., three melody tones C, E, and G are generated, C#, F, and G#tones higher than the melody tones by a halftone are generated as harmonic tones.

In this manner, the same effect as described above can be obtained.

(2) In the above embodiment, in the unison mode, the second channel of the TG 108 for generating only a harmonic tone generates a tone in addition to its first channel for generating a melody tone. However, when the second channel does not generate a tone in the unison mode, the same effect as described above can be obtained.

(3) In the above embodiment, melody and harmonic tones have different tone colors. However, when the two tones have the same tone color, the same effect as described above can be obtained.

As has been described above, according to the present invention, pitch difference data representing a pitch difference between a melody tone and a harmonic tone generated in a duet mode can be held in accordance with an operation of a performer. Therefore, the pitch difference between the melody and harmonic tones can be changed in accordance with the performer's need in performance. As a result, a more expressive performance tone can be generated.

What is claimed is:

1. An electronic musical instrument comprising:

pitch designating means for selectively designating a pitch of a musical tone to be generated;

first musical tone generating means for generating a first musical tone signal of a first pitch corresponding to the pitch designated by said pitch designating means;

second musical tone generating means for generating a second musical tone signal of a second pitch corresponding to the pitch designated by said pitch designating means;

pitch hold designating means for generating a pitch hold command; and control means responsive to said pitch hold command for maintaining said second pitch of said second musical tone signal generated by said second musical tone generating means at a pitch designated prior to generation of said pitch hold command regardless of subsequent designation of a different pitch by said pitch designating means.

2. A musical instrument according to claim 1, wherein said pitch hold designating means is a switch which can be operated by a performer.

3. A musical instrument according to claim 1, wherein said pitch designating means is a keyboard having a plurality of keys, and said control means holds the second musical tone signal at a predetermined pitch regardless of a key operation at said keyboard.

4. A musical instrument according to claim 1, further comprising volume setting means for setting a volume of the musical tone generated from said second musical tone generating means, wherein said control means disables volume setting of said volume setting means responsive to said pitch hold command generated by said pitch hold designating means.

5. A musical instrument according to claim 1, further comprising volume setting means for setting a volume of the musical tone generated by said second musical tone generating means with an operation member, wherein said control means, responsive to said pitch hold command generated by said pitch hold designating means, sets the volume of the second musical tone signal generated by said second musical tone generating means to be a value corresponding to an operation amount of said operation member of said volume setting means.

6. An electronic musical instrument comprising:

pitch designating means for designating a pitch of a musical tone to be generated;

musical tone control information generating means for outputting musical tone control information for controlling the musical tone;

converting means for converting the musical tone control information in a predetermined conversion manner and outputting converted musical tone control information;

first musical tone generating means for generating a first musical tone signal on the basis of the pitch designated by said pitch designating means and the musical tone control information;

second musical tone generating means for generating a second musical tone signal on the basis of the pitch designated by said pitch designating means and the converted musical tone control information;

pitch hold designating means for generating a pitch hold command; and control means responsive to said pitch hold command at a pitch designated prior to generation of said pitch hold command regardless of subsequent designation of a different pitch by said pitch designating means.

7. A musical instrument according to claim 6, wherein the musical tone control information is a volume.

8. An electronic musical instrument comprising:

duet mode designating means for designating a duet mode having first and second musical tones to be substantially simultaneously produced;

pitch designating means for designating a pitch of the first musical tone to be produced in correspondence with a duet mode designated by the duet mode designating means;

first musical tone generating means for generating a first musical tone signal corresponding to the pitch designated by said pitch designating means;

pitch difference designating means for selectively designating a desired pitch difference between the first and second musical tones to be substantially simultaneously produced; and second musical tone generating means responsive to operation of said duet mode designating means for generating a second musical tone signal having a pitch different from the pitch of the first musical tone signal by the desired pitch difference.

9. A musical instrument according to claim 8, wherein said pitch difference designating means designates the desired pitch difference by detecting a pitch difference between first and second pitches sequentially designated by said pitch designating means.

10. A musical instrument according to claim 8, wherein said second musical tone generating means generates the second musical tone signal having the same pitch as that of the first musical tone signal when said duet mode designating means does not designate the duet mode.

11. A musical instrument according to claim 8, wherein said first and second musical tone generating means generate melody and harmonic tones having different tone colors as the first and second musical tone signals, respectively.

* * * * *